US010783735B2

(12) United States Patent
Nishida et al.

(10) Patent No.: US 10,783,735 B2
(45) Date of Patent: Sep. 22, 2020

(54) SHEET STORAGE APPARATUS AND SHEET STORAGE METHOD

(71) Applicant: GLORY LTD., Hyogo (JP)

(72) Inventors: Koichi Nishida, Himeji (JP); Keiju Nakagawa, Himeji (JP); Youichi Takemura, Himeji (JP); Koichi Nabeyama, Himeji (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/317,435

(22) PCT Filed: May 29, 2017

(86) PCT No.: PCT/JP2017/019889
§ 371 (c)(1),
(2) Date: Jan. 11, 2019

(87) PCT Pub. No.: WO2018/012128
PCT Pub. Date: Jan. 18, 2018

(65) Prior Publication Data

US 2019/0304233 A1 Oct. 3, 2019

(30) Foreign Application Priority Data

Jul. 14, 2016 (JP) ..... 2016-139274
Sep. 16, 2016 (JP) ..... 2016-181969

(51) Int. Cl.
*G07D 11/12* (2019.01)
*G07D 11/00* (2019.01)
(Continued)

(52) U.S. Cl.
CPC ..... *G07D 11/12* (2019.01); *B65H 31/26* (2013.01); *E05G 1/005* (2013.01); *E05G 7/001* (2013.01);
(Continued)

(58) Field of Classification Search
CPC .... G07D 11/125; G07D 11/12; G07D 11/009; G07D 11/0096; G07D 11/0093;
(Continued)

(56) References Cited

U.S. PATENT DOCUMENTS

2005/0086140 A1* 4/2005 Ireland ..... B32B 27/36 705/35
2010/0189379 A1* 7/2010 Razzaboni ..... E05G 7/001 383/33
(Continued)

FOREIGN PATENT DOCUMENTS

JP 2007034869 A * 2/2007 ..... B65H 31/22
JP 2011-118651 6/2011
(Continued)

OTHER PUBLICATIONS

Extended European Search Report in counterpart European application No. 17827261.3, dated Mar. 16, 2020.
(Continued)

*Primary Examiner* — Luis A Gonzalez
(74) *Attorney, Agent, or Firm* — Greenblum & Bernstein, P.L.C.

(57) ABSTRACT

A sheet storage apparatus (for example, banknote handling machine includes: a holding unit (for example, each holding member) configured to hold a storage bag in a state where an opening portion of a banknote storage bag is opened or in a state where the opening portion of the banknote storage bag is sealed; a regulation unit configured to selectively regulate access to the banknote storage bag held by the holding unit; and a control unit configured to control the regulation unit so as to allow access to the banknote storage bag held by the holding unit in a state where the opening portion of the banknote storage bag is opened when a predetermined condition is satisfied.

16 Claims, 15 Drawing Sheets

(51) Int. Cl.

| | |
|---|---|
| ***B65H 31/26*** | (2006.01) |
| ***G07D 9/00*** | (2006.01) |
| ***G07D 13/00*** | (2006.01) |
| ***G07F 19/00*** | (2006.01) |
| ***G07D 11/125*** | (2019.01) |
| ***E05G 1/00*** | (2006.01) |
| ***E05G 7/00*** | (2006.01) |

(52) U.S. Cl.
CPC ..... *G07D 9/00* (2013.01); *G07D 11/009* (2013.01); *G07D 11/125* (2019.01); *G07D 13/00* (2013.01); *G07F 19/202* (2013.01)

(58) Field of Classification Search
CPC ..... G07D 11/20; G07D 11/26; G07D 11/30; G07D 11/32; E05G 1/005; E05G 7/001
See application file for complete search history.

(56) References Cited

U.S. PATENT DOCUMENTS

2010/0247000 A1* 9/2010 Goodwin ..... B65D 33/34 383/43
2012/0047854 A1* 3/2012 Wright ..... E05G 1/005 53/476
2013/0213763 A1* 8/2013 Rao ..... G07D 11/32 194/350
2014/0254960 A1 9/2014 Tanaike et al.

FOREIGN PATENT DOCUMENTS

| | | |
|---|---|---|
| JP | 2013-097612 | 5/2013 |
| JP | 2014-174581 | 9/2014 |
| JP | 2015-056010 | 3/2015 |
| JP | 2016-018296 | 2/2016 |
| JP | 2016-146142 | 8/2016 |

OTHER PUBLICATIONS

Japanese Office Action in counterpart Japanese application No. 2016-181969, dated Apr. 6, 2020 (along with English translation thereof).
Japanese Office Action in counterpart Japanese application No. 2016-139274, dated May 13, 2020 (along with English translation thereof).
Official Communication issued in International Patent Application No. PCT/JP2017/019889, dated Jul. 4, 2017, along with an English translation thereof.

* cited by examiner

SHEET STORAGE APPARATUS AND SHEET STORAGE METHOD

TECHNICAL FIELD

The present invention relates to a sheet storage apparatus and a sheet storage method for storing sheets such as banknotes in a storage bag such as a pouch.

BACKGROUND ART

To date, such an apparatus that stores sheets taken in into the apparatus, in a storage bag such as a pouch, has been used as a sheet storage apparatus for storing sheets such as banknotes. As such a sheet storage apparatus, for example, an apparatus disclosed in Japanese Laid-Open Patent Publication No. 2014-174581 or the like has been conventionally known. According to Japanese Laid-Open Patent Publication No. 2014-174581, for example, such a sheet storage apparatus is used as a part of a cash accounting device installed in a back office region in a store such as a supermarket. The cash accounting device performs dispensing of money as change fund with which a cash settlement device disposed in a front office region is to be replenished, and depositing of money, as proceeds from sales, collected from the cash settlement device. In such a cash accounting device, banknotes to be collected by, for example, a guard of a cash-in-transit company are stored in a storage bag such as a pouch.

SUMMARY OF THE INVENTION

In a conventional cash settlement device which comprises the sheet storage apparatus disclosed in Japanese Laid-Open Patent Publication No. 2014-174581 stores banknotes taken in into the apparatus by a taking-in unit and recognized by a recognition unit in a storage bag such as a pouch. When the storage bag such as a pouch is collected by, for example, a guard of a cash-in-transit company, an opening portion of the storage bag is automatically sealed by a sealing unit. Meanwhile, since before, there has been a request for manually inserting sheets such as banknotes or checks directly into the storage bag held by a holding unit in a state where the opening portion of the storage bag is opened, without transporting the sheets through the taking-in unit, a transport unit, and the recognition unit. However, a problem arises that the conventional cash settlement device cannot allow sheets to be additionally stored as described above.

The present invention has been made in view of such circumstances, and an object of the present invention is to provide a sheet storage apparatus and a sheet storage method that can allow sheets to be additionally stored in a storage bag and allow sheets to be taken out from the storage bag in a state where the storage bag is held by a holding unit in such a manner as an opening portion of the storage bag is opened when a predetermined condition is satisfied.

A sheet storage apparatus of the present invention includes: a holding unit configured to hold a storage bag in a state where an opening portion of the storage bag is opened or in a state where the opening portion of the storage bag is sealed; a sealing unit configured to seal the opening portion of the storage bag held by the holding unit; a regulation unit configured to selectively regulate access to the storage bag held by the holding unit; and a control unit configured to control the regulation unit so as to allow access to the storage bag held by the holding unit in a state where the opening portion of the storage bag is opened when a predetermined condition is satisfied.

The sheet storage apparatus of the present invention may further include: a housing; and a drawer unit in which at least the holding unit is disposed, the drawer unit configured to be drawn outward from the housing, the regulation unit may include a locking unit configured to regulate drawing of the drawer unit to outside of the housing, and the control unit may control the locking unit so as to allow the drawer unit to be drawn to outside of the housing when the predetermined condition is satisfied.

The sheet storage apparatus of the present invention may further include: a housing; a drawer unit in which at least the holding unit is disposed, the drawer unit configured to be drawn outward from the housing; and a door provided with the housing, the door configured to be opened when the drawer unit may be drawn outward from the housing, the regulation unit may include a door locking unit configured to lock the door in a closed state, and the control unit may control the door locking unit so as to unlock the door having been in the closed state when the predetermined condition is satisfied.

In the sheet storage apparatus of the present invention, the regulation unit may include an opening and closing unit for opening or closing a path between outside of the housing and the opening portion of the storage bag held by the holding unit; and the control unit may control the opening and closing unit so as to open the path between outside of a housing and the opening portion of the storage bag held by the holding unit when the predetermined condition is satisfied.

The sheet storage apparatus of the present invention may further include: a taking-in unit configured to take in a sheet into the housing; a transport unit configured to transport the sheet taken in into the housing by the taking-in unit; and a recognition unit configured to recognize the sheet transported by the transport unit, and the control unit may control the regulation unit so as to allow the sheet to be stored into the storage bag held by the holding unit without transporting the sheet through the taking-in unit, the transport unit, and the recognition unit when the predetermined condition is satisfied.

In this case, the control unit may determine that the predetermined condition is satisfied when an instruction for inserting the sheet in the storage bag held by the holding unit without transporting the sheet through the taking-in unit, the transport unit, and the recognition unit, is inputted.

The sheet storage apparatus of the present invention may further include: an instruction unit configured to output the instruction to insert the sheet in the storage bag held by the holding unit without transporting the sheet through the taking-in unit, the transport unit, and the recognition unit, and the instruction to insert the sheet in the storage bag held by the holding unit without transporting the sheet through the taking-in unit, the transport unit, and the recognition unit, may be inputted into the control unit when the instruction unit is operated.

The sheet storage apparatus of the present invention may further include: an input unit configured to allow input of information on the sheet to be stored in the storage bag held by the holding unit without transporting the sheet through the taking-in unit, the transport unit, and the recognition unit.

In the sheet storage apparatus of the present invention, information on the sheet which is stored into the storage bag held by the holding unit without transporting the sheet through the taking-in unit, the transport unit, and the recognition unit, and information on a sheet which is stored into a storage bag held by the holding unit through the taking-in unit, the transport unit, and the recognition unit, may be managed by the control unit so as to be distinguished from each other.

The sheet storage apparatus of the present invention may further include: an authentication unit configured to perform authentication of authority of an operator, and the control unit may determine that the predetermined condition is satisfied when the authority of the operator authenticated by the authentication unit is a predetermined authority.

In the sheet storage apparatus of the present invention, the holding unit may comprise a plurality of holding units, predetermined conditions corresponding to storage bags held by the holding units, respectively, may be set, and for each of the storage bags held by the holding units, the control unit may control the regulation unit so as to allow access to the storage bag held by the holding unit in a state where an opening portion of the storage bag is opened when the predetermined condition corresponding to the storage bag is satisfied.

In the sheet storage apparatus of the present invention, when access to the storage bag held by the holding unit is allowed in a state where the opening portion of the storage bag is opened, the sealing unit may seal the opening portion of the storage bag in a manner different from a manner for a case where access to the storage bag is not allowed.

A sheet storage method of the present invention performed by a sheet storage apparatus includes: a holding unit configured to hold a storage bag in a state where an opening portion of the storage bag is opened or in a state where the opening portion of the storage bag is sealed; and a sealing unit configured to seal the opening portion of the storage bag held by the holding unit, the sheet storage method including: storing a sheet in the storage bag held by the holding unit in a state where the opening portion of the storage bag is opened while regulating access to the storage bag held by the holding unit; sealing the opening portion of the storage bag held by the holding unit, by the sealing unit, when the storage bag is taken out from the sheet storage apparatus; and allowing access to the storage bag held by the holding unit in a state where the opening portion of the storage bag is opened when a predetermined condition is satisfied.

In the sheet storage method of the present invention, the sheet storage apparatus may further include: a taking-in unit configured to take in a sheet into a housing; a transport unit configured to transport the sheet taken in into the housing by the taking-in unit; and a recognition unit configured to recognize the sheet transported by the transport unit, and in storing the sheet in the storage bag held by the holding unit in a state where the opening portion of the storage bag is opened, the sheet may be stored into the storage bag held by the holding unit through the taking-in unit, the transport unit, and the recognition unit, and when the predetermined condition is satisfied, the sheet may be allowed to be stored into the storage bag held by the holding unit without transporting the sheet through the taking-in unit, the transport unit, and the recognition unit.

A money handling machine of the present invention includes: a mounting unit to which a storage bag for storing money is mounted; a sealing unit configured to seal an opening portion of the storage bag mounted to the mounting unit; a recognition unit configured to recognize money to be stored in the storage bag mounted to the mounting unit; a setting unit configured to select and set a sealing method of the opening portion of the storage bag from a plurality of sealing methods based on the recognition result by the recognition unit; and a control unit configured to control the sealing unit so as to seal the opening portion of the storage bag mounted to the mounting unit based on the sealing method set by the setting unit.

In the money handling machine of the present invention, the sealing unit may include a sealing member for sealing the opening portion of the storage bag mounted to the mounting unit, the setting unit may set a position to be sealed by the sealing member in the storage bag mounted to the mounting unit based on the recognition result by the recognition unit as the sealing method of the opening portion of the storage bag, the control unit may control the sealing member of the sealing unit so as to seal the position set by the setting unit in the storage bag mounted to the mounting unit.

In this case, the sealing member may seal the opening portion of the storage bag mounted to the mounting unit by heat, the storage bag to be mounted to the mounting unit may be provided with a plurality of heat-sensitive light emission layers of different colors, when setting the position to be sealed by the sealing member in the storage bag mounted to the mounting unit, the setting unit may select and set the heat-sensitive light emission layer to be sealed by the sealing member among the plurality of heat-sensitive light emission layers provided in the storage bag based on the recognition result by the recognition unit, and the control unit may control the sealing member of the sealing unit so as to seal the heat-sensitive light emission layer set by the setting unit.

In the money handling machine of the present invention, a printing member configured to print on the storage bag mounted to the mounting unit is disposed, the setting unit may set a printing content to be printed on the storage bag by the printing member based on the recognition result by the recognition unit as the sealing method of the opening portion of the storage bag, and the control unit may control the printing member to perform printing on the storage bag mounted to the mounting unit based on printing content set by the setting unit.

In this case, the printing member may perform printing on a portion sealed by the sealing unit in the storage bag mounted to the mounting unit In the money handling machine of the present invention, a marking member for marking the storage bag mounted to the mounting unit may be provided, the setting unit may set content to be marked on the storage bag by the marking member as the sealing method of the opening portion of the storage bag based on the recognition result by the recognition unit, and the control unit may control the marking member so as to perform marking on the storage bag mounted to the mounting unit based on the content to be marked set by the setting unit.

In this case, the marking member may perform marking on a portion sealed by the sealing unit in the storage bag mounted to the mounting unit.

In the money handling machine of the present invention, a cutting member for partially cutting the storage bag mounted to the mounting unit may be provided, the setting unit may set a portion to be cut by the cutting member in the storage bag mounted to the mounting unit based on the recognition result by the recognition unit as the sealing method of the opening portion of the storage bag, and the control unit may control the cutting member to cut the portion set by the setting unit in the storage bag mounted to the mounting unit.

In the money handling machine of the present invention, when the number or a monetary amount of money stored in the storage bag mounted to the mounting unit has not been accepted, based on the recognition result by the recognition unit, the setting unit may set the sealing method of the opening portion of the storage bag to be different from the case where the number or a monetary amount of money stored in the storage bag mounted to the mounting unit is accepted.

Alternatively, the setting unit may set the sealing method of the opening portion of the storage bag corresponding to the number or a monetary amount of money stored in the storage bag mounted to the mounting unit based on the recognition result by the recognition unit from the plurality of sealing methods.

Alternatively, when the number or a monetary amount of money stored in the storage bag mounted to the mounting unit is greater than a predetermined number or a predetermined monetary amount having been preset, based on the recognition result by the recognition unit, the setting unit may set the sealing method of the opening portion of the storage bag to be different from the case where the number or a monetary amount of money stored in the storage bag mounted to the mounting unit is less than the predetermined number or the predetermined monetary amount having been preset.

Alternatively, the setting unit may set the sealing method of the opening portion of the storage bag corresponding to a denomination of money stored in the storage bag mounted to the mounting unit based on the recognition result by the recognition unit from the plurality of sealing methods.

In this case, when money of a plurality of denominations is stored in the storage bag mounted to the mounting unit, based on the recognition result by the recognition unit, the setting unit may set the sealing method of the opening portion of the storage bag to be different from the case where money of single denomination is stored in the storage bag mounted to the mounting unit.

Alternatively, when at least one money stored in the storage bag mounted to the mounting unit is not genuine money, based on the recognition result by the recognition unit, the setting unit may set the sealing method of the opening portion of the storage bag to be different from the case where all money stored in the storage bag mounted to the mounting unit is genuine money.

A money handling machine of the present invention includes: a mounting unit to which a storage bag for storing money is mounted; a sealing unit configured to seal an opening portion of the storage bag mounted to the mounting unit; an input unit configured to input information on handling of money; a setting unit configured to select and set a sealing method of the opening portion of the storage bag from a plurality of sealing methods based on information inputted by the input unit; and a control unit configured to control the sealing unit so as to seal the opening portion of the storage bag mounted to the mounting unit based on the sealing method set by the setting unit.

In the money handling machine of the present invention, the information on handling of money inputted by the input unit may be one of a date and time when the money is handled, a date and time when the opening portion of the storage bag is sealed by the sealing unit, a person in charge of handling of money, a place where the money handling machine is installed, and information on the following handling step performed next to the money handling machine.

A money handling method of the present invention includes: mounting a storage bag for storing money to a mounting unit; recognising money to be stored in the storage bag mounted to the mounting unit by a recognition unit; selecting and setting a sealing method of an opening portion of the storage bag from a plurality of sealing methods based on a recognition result by the recognition unit; and sealing the opening portion of the storage bag mounted to the mounting unit based on the set sealing method.

A money handling method of the present invention includes: mounting a storage bag for storing money to a mounting unit; inputting information on handling of money; selecting and setting a sealing method of an opening portion of the storage bag from a plurality of sealing methods based on information inputted by the input unit; and sealing the opening portion of the storage bag mounted to the mounting unit based on the set sealing method.

BRIEF DESCRIPTION OF THE DRAWINGS

FIG. 4 is a perspective view of a configuration of a banknote storage bag to be held by each holding member in the banknote storage mechanism shown in FIG. 2 and the like;

FIG. 7 is a functional block diagram illustrating a configuration of a control system of the banknote handling machine shown in FIG. 1 and the like;

FIG. 21 is a functional block diagram illustrating a configuration of a control system of the banknote depositing machine shown in FIG. 19 and the like.

DESCRIPTION OF THE PREFERRED EMBODIMENTS

First Embodiment

A first embodiment of the present invention will be described below with reference to the drawings. FIG. 1 to FIG. 7 illustrate a banknote handling machine 10 according to the first embodiment.

Figure 1:
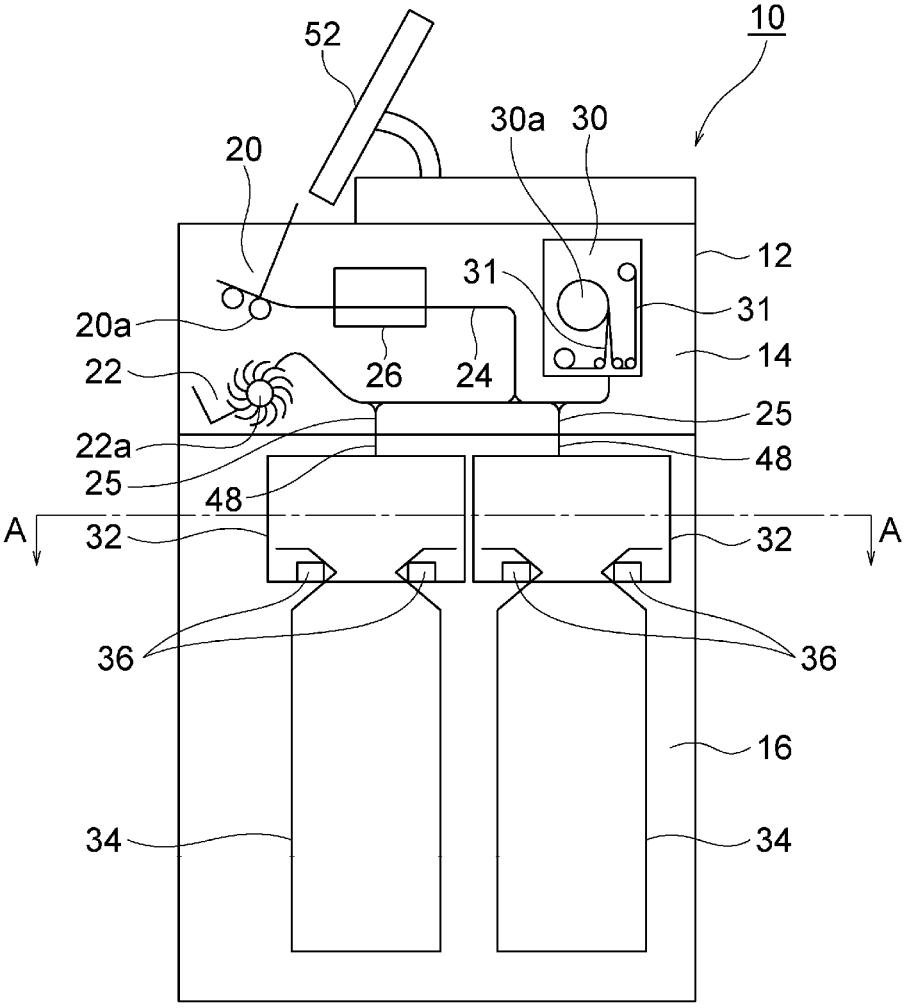
FIG. 1 schematically illustrates an example of a configuration of a banknote handling machine according to a first embodiment of the present invention.

The banknote handling machine 10 according to the present embodiment is disposed in a front office region or a back office region in a store such as a supermarket, in a bank lobby, or inside a bank, in general. The banknote handling machine 10 can perform various handlings such as depositing of banknotes. As shown in FIG. 1, the banknote handling machine 10 of the present embodiment has an almost rectangular-parallelepiped-shaped housing 12. In FIG. 1, the surface, of the housing 12, on the left side is a front surface (that is, a surface which an operator faces) of the housing 12. An upper assembly 14 and a lower assembly 16 are stored in the housing 12 and able to be drawn forward (specifically, leftward in FIG. 1) from the front surface of the housing 12. An inlet unit 20 such as a receptacle which takes in a banknote from the outside into the housing 12 is disposed at the upper portion on the front surface (the upper portion on the left side surface in FIG. 1) of the housing 12 at the upper assembly 14. Furthermore, an outlet unit 22 for discharging a banknote from the housing 12 to the outside is disposed below the inlet unit 20 on the front surface (the left side surface in FIG. 1) of the housing 12 at the upper assembly 14.

The inlet unit 20 is provided with a banknote feeding mechanism 20*a* for taking in banknotes that are placed in a stacked state in the inlet unit 20 by an operator into the housing 12 one by one. A transport unit 24 for transporting banknotes one by one in the housing 12 is disposed at the upper assembly 14 in the housing 12 of the banknote handling machine 10, and the banknotes taken in from the inlet unit 20 by the banknote feeding mechanism 20*a* are transported one by one by the transport unit 24. A recognition unit 26 is disposed in the transport unit 24, and the recognition unit 26 recognizes a denomination, authenticity, face/back, fitness, new/old series, a transport state of a banknote taken in into the transport unit 24 by the banknote feeding mechanism 20*a*.

As shown in FIG. 1, the outlet unit 22 is connected to the transport unit 24, and banknotes transported to the outlet unit 22 from the transport unit 24 are stacked in the outlet unit 22. The outlet unit 22 can be accessed from the outside of the housing 12, and an operator is allowed to take out the banknotes stacked in the outlet unit 22 from the front surface of the housing 12. A stacking wheel 22*a* is disposed at a portion at which the transport unit 24 is connected to the outlet unit 22, and the stacking wheel 22*a* rotates in the counterclockwise direction in FIG. 1. When a banknote is transported from the transport unit 24 to the outlet unit 22, the stacking wheel 22*a* rotates in the counterclockwise direction in FIG. 1 in a state where the banknote is held between two vanes of the stacking wheel 22*a*, whereby the banknote held between the two vanes of the stacking wheel 22*a* can be stacked in the outlet unit 22 in an aligned state.

In the upper assembly 14, a tape-type storage/feeding unit 30 is disposed at the transport unit 24, and a banknote transported from the transport unit 24 to the storage/feeding unit 30 is stored in the storage/feeding unit 30 and banknotes stored in the storage/feeding unit 30 can be fed out one by one to the transport unit 24. More specifically, the storage/feeding unit 30 has a drum 30*a* that can perform both forward rotation and reverse rotation, and one end of a pair of band-like tapes 31 is connected to the outer circumferential surface of the drum 30*a*. When banknotes are transported from the transport unit 24 to the storage/feeding unit 30, the band-like tapes 31 allow the banknotes to be wound together with the tapes 31 on the drum 30*a* one by one. Meanwhile, when each tape 31 is wound back from the drum 30*a* by reverse rotation of the drum 30*a*, the banknote wound on the drum 30*a* is also released from each tape 31 and fed out to the transport unit 24.

Figure 2:
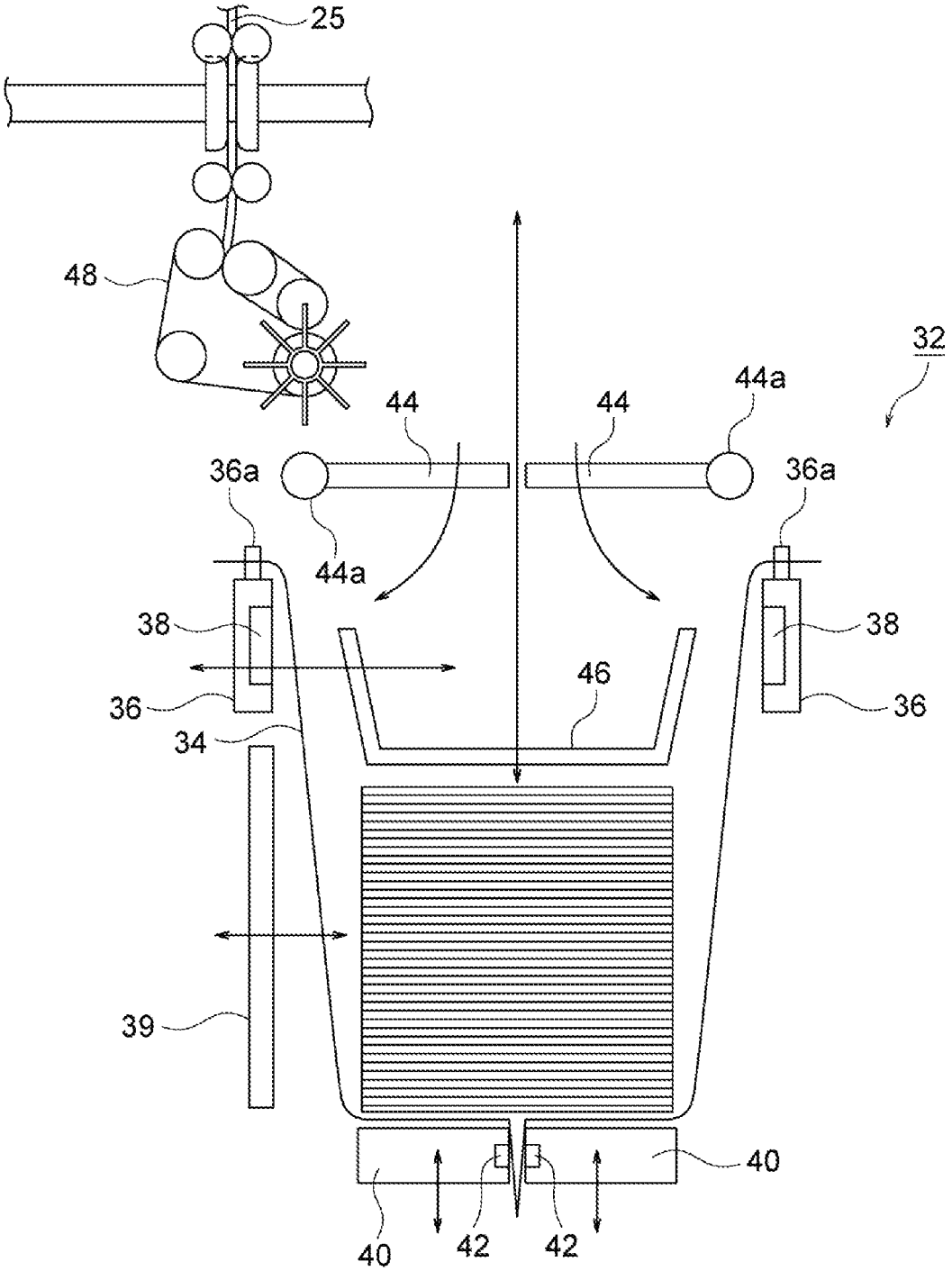
FIG. 2 is a side view showing in detail a configuration of a banknote storage mechanism in the banknote handling machine shown in FIG. 1.

As shown in FIG. 1, in the present embodiment, the lower assembly 16 has a plurality (for example, two) of banknote storage mechanisms 32 each of which stores banknotes in a banknote storage bag 34 such as a pouch having an opening portion on one side. Each banknote storage mechanism 32 has a pair of holding members 36 that are spaced so as to face each other. The holding members 36 hold two opening portions of the banknote storage bag 34 which are near the opening of the banknote storage bag 34 and face each other. The first holding member 36 (specifically, for example, the holding member 36 on the right side in FIG. 1 and FIG. 2) is fixedly positioned, whereas the second holding member 36 (specifically, for example, the holding member 36 on the left side in FIG. 1 and FIG. 2) can be moved toward the first holding member 36 that is fixedly positioned. As shown in FIG. 2, each holding member 36 is provided with a heating member 38. After a predetermined number of banknotes are stored in the banknote storage bag 34 held by each holding member 36 disposed in the banknote storage mechanism 32, before the banknote storage bag 34 is taken out from the banknote storage mechanism 32, the second holding member 36 is moved toward the first holding members 36 and the two holding members 36 touch each other. In this state, each heating member 38 heats an opening portion near the opening of the banknote storage bag 34, whereby the opening portion of the banknote storage bag 34 is heat-sealed (thermally sealed). In the banknote storage mechanism 32, instead of the second holding member 36 being moved toward the first holding member 36, both the holding members 36 may be moved toward each other up to the center position, and the holding members 36 may touch each other at the center position.

A plurality (two in the example shown in FIG. 1) of diverged transport units 25 corresponding to the banknote storage mechanisms 32, respectively, diverge from the transport unit 24 in the upper assembly 14. A banknote diverted from the transport unit 24 to the diverged transport unit 25 is sent from the diverged transport unit 25 to the banknote storage bag 34 mounted to the banknote storage mechanism 32, and stored in the banknote storage bag 34.

Figure 3:
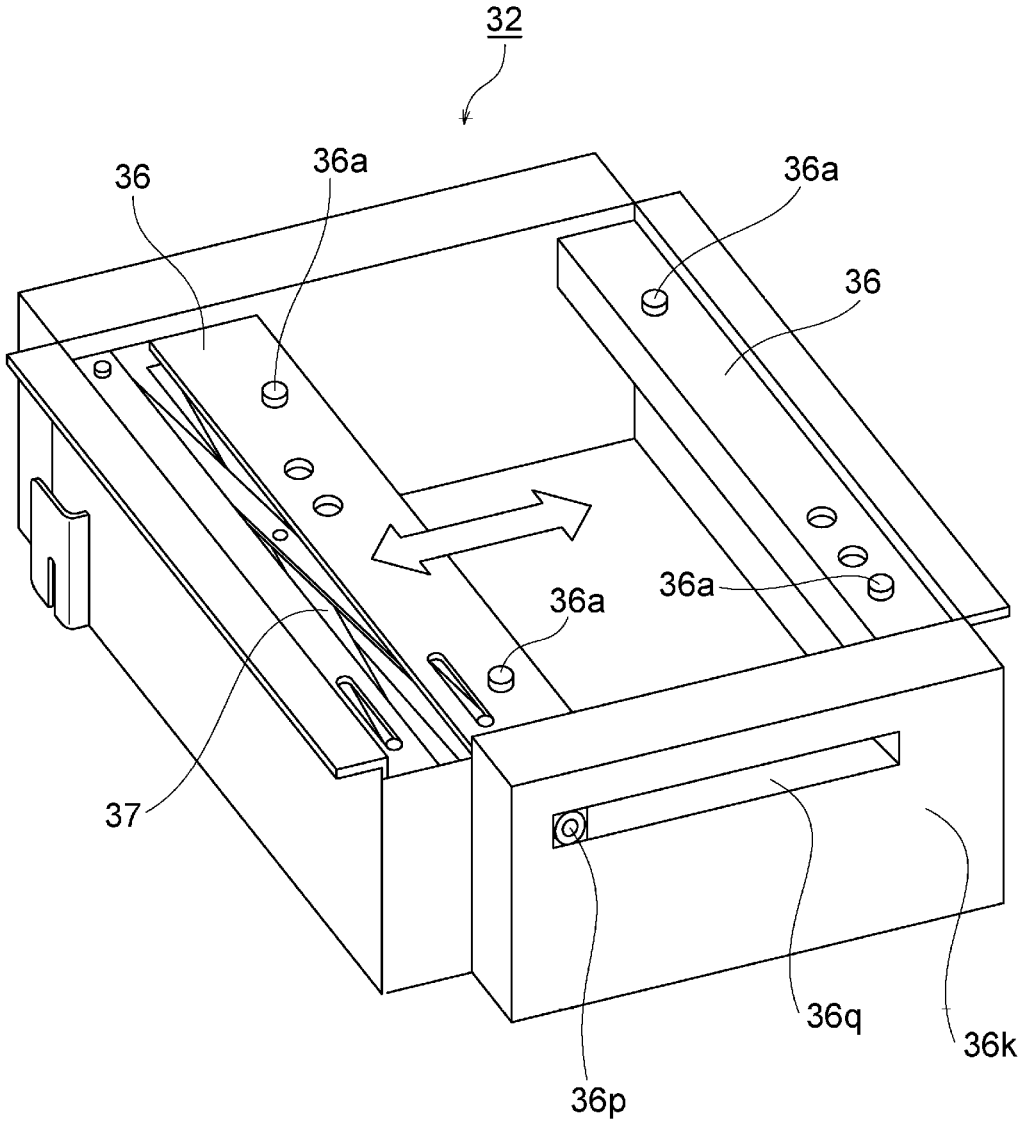
FIG. 3 is a perspective view of a configuration of a pair of holding members and the like in the banknote storage mechanism shown in FIG. 2.
Figure 4:
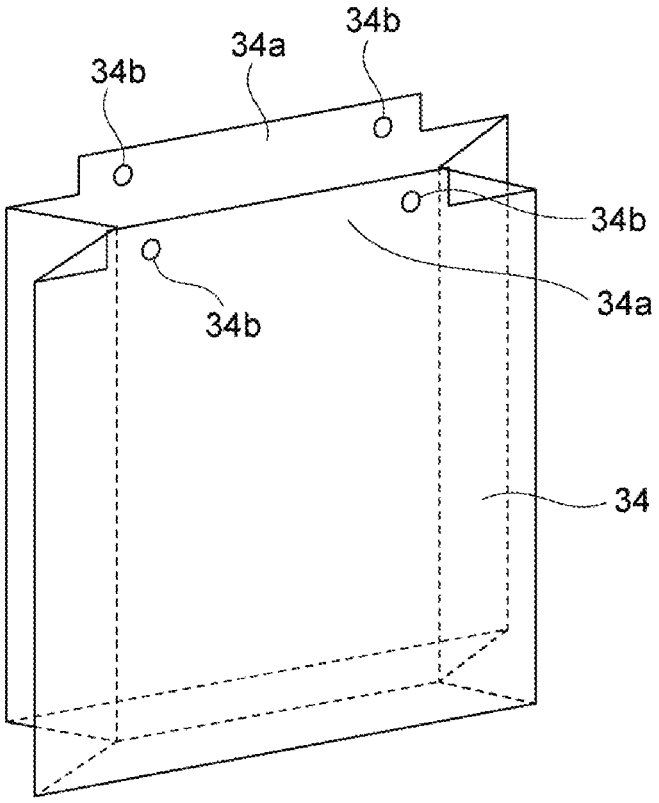

Next, a configuration of the banknote storage mechanism 32 according to the present embodiment will be described in detail with reference to FIG. 2 to FIG. 4. FIG. 2 is a side view showing in detail the configuration of the banknote storage mechanism 32. FIG. 3 is a perspective view of a configuration of the pair of holding members 36 and the like in the banknote storage mechanism 32 shown in FIG. 2. FIG. 4 is a perspective view of a configuration of the banknote storage bag 34, such as a pouch, to be held by each holding member 36 in the banknote storage mechanism 32 shown in FIG. 2 and the like.

As shown in FIG. 2, the banknote storage mechanism 32 has: a banknote sending unit 48 for sending a banknote transported from the diverged transport unit 25 of the upper assembly 14 to the lower assembly 16, to the banknote storage bag 34 held by the pair of holding members 36; a temporary storage unit 44 for temporarily storing the banknotes sent by the banknote sending unit 48; and a stage 40 on which the bottom portion of the banknote storage bag 34 held by the pair of holding members 36 is placed.

As shown in FIG. 2, the banknote sending unit 48 is constituted by a roller and a belt in combination, and sends banknotes transported from the diverged transport unit 25 of the upper assembly 14 to the lower assembly 16, one by one, to the temporary storage unit 44, to stack the banknotes on the temporary storage unit 44. Furthermore, the temporary storage unit 44 is implemented by a pair of left and right temporary storage units, and each temporary storage unit 44 can rotate about a rotating axis of a shaft 44*a* disposed at the end portion of the temporary storage unit 44 in the downward direction (that is, directions indicated by arrows in FIG. 2). The stage 40 is implemented by a pair of left and right stages. Each stage 40 can be moved in the up-down direction and the left-right direction in FIG. 2. A gap is formed between the paired stages 40. A part of the banknote storage bag 34 held by the holding members 36 can be extended downward from each stage 40 through the gap. Each stage 40 is driven by a stage driving unit 41 (see FIG. 7) such as an electric actuator.

As shown in FIG. 2, a heating member 42 is disposed at each stage 40. Before the banknote storage bag 34 is taken out from the banknote storage mechanism 32, the first stage 40 (for example, the stage 40 on the left side in FIG. 2) is moved toward the second stage 40 (for example, the stage 40 on the right side in FIG. 2), and the stages 40 touch each other. In this state, each heating member 42 heats a portion, of the banknote storage bag 34, near the bottom portion thereof, whereby the bottom portion of the banknote storage bag 34 is heat-sealed (thermally sealed). In the banknote storage mechanism 32, instead of the first stage 40 being moved toward the second stage 40, both the stages 40 may be moved toward each other up to the center position and touch each other at the center position.

As shown in FIG. 3, a pantograph 37 is disposed at the second holding member 36 on the left side among the pair of left and right holding members 36, the second holding member 36 on the left side is moved toward the first holding member 36 on the right side by the pantograph 37, and the holding members 36 touch each other. More specifically, a guide pin 36*p* is disposed at the end portion of the second holding member 36 on the left side, and a frame 36*k* that supports each holding member 36 has a linear long hole 36*q* by which the guide pin 36*p* is guided. The long hole 36*q* extends in the frame 36*k* in the horizontal direction. When the pantograph 37 is extended, the guide pin 36*p* disposed at the second holding member 36 on the left side is guided along the long hole 36*q*, whereby the second holding member 36 on the left side is moved toward the first holding member 36 on the right side.

As shown in FIG. 3, two pins 36*a* are disposed on the upper surface of each of the paired left and right holding members 36. As shown in FIG. 4, paired protrusions 34*a* each having two holes 34*b* are disposed at portions (that is, the upper end portion of the banknote storage bag 34), near the opening portion, of the banknote storage bag 34 to be held by each holding member 36. When the banknote storage bag 34 is held by the holding members 36, the pins 36*a* of the holding members 36 pass through the holes 34*b*, respectively, disposed in the protrusions 34*a* of the banknote storage bag 34, whereby the protrusions 34*a* are held by the holding members 36, respectively.

A pressing plate 46 is disposed above the pair of temporary storage units 44. The pressing plate 46 is provided with a pantograph 47 (see FIG. 7, not shown in FIG. 2), and the pantograph 47 extends and contracts in the up-down direction in FIG. 2, whereby the pressing plate 46 can be moved in a range indicated by arrows in FIG. 2 in the up-down direction. As shown in FIG. 2, by the pressing plate 46 being thus moved downward, when banknotes temporarily stored on the temporary storage units 44 are stored in the banknote storage bag 34, the banknotes temporarily stored on the temporary storage units 44 can be pushed toward the banknote storage bag 34.

As shown in FIG. 2, a one-side aligning lever 39 is disposed below the second holding member 36 on the left side among the pair of holding members 36, and banknotes that are stored in the banknote storage bag 34 held by the pair of holding members 36 are aligned on one side (specifically, the right side in FIG. 2) in the banknote storage bag 34 by the one-side aligning lever 39. More specifically, the one-side aligning lever 39 in the state shown in FIG. 2 is moved rightward by a one-side aligning lever driving unit 39*a* (see FIG. 7) that includes a pantograph, an electric actuator, and the like.

In the banknote handling machine 10 of the present embodiment, as described above, the upper assembly 14 and the lower assembly 16 are stored in the housing 12 and able to be drawn forward (specifically, leftward in FIG. 1) from the front surface of the housing 12. An operation for drawing the lower assembly 16 stored in the housing 12, from the front surface of the housing 12 in the forward direction, will be described with reference to FIG. 5 and FIG. 6.

Figure 5:
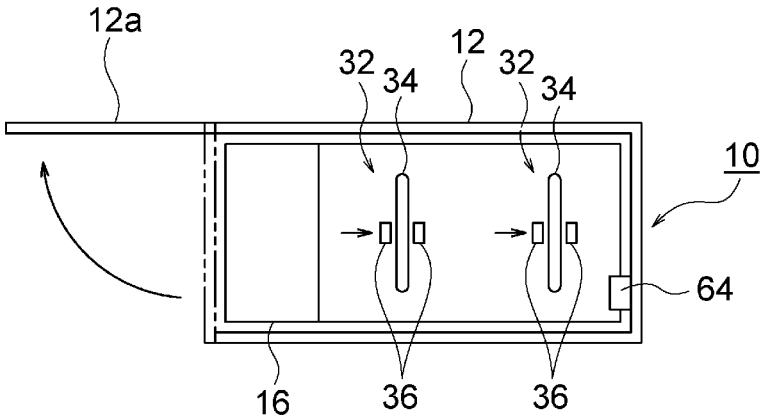
FIG. 5 illustrates an internal structure of a lower assembly of the banknote handling machine shown in FIG. 1 as viewed from the direction of arrows A-A.
Figure 6:
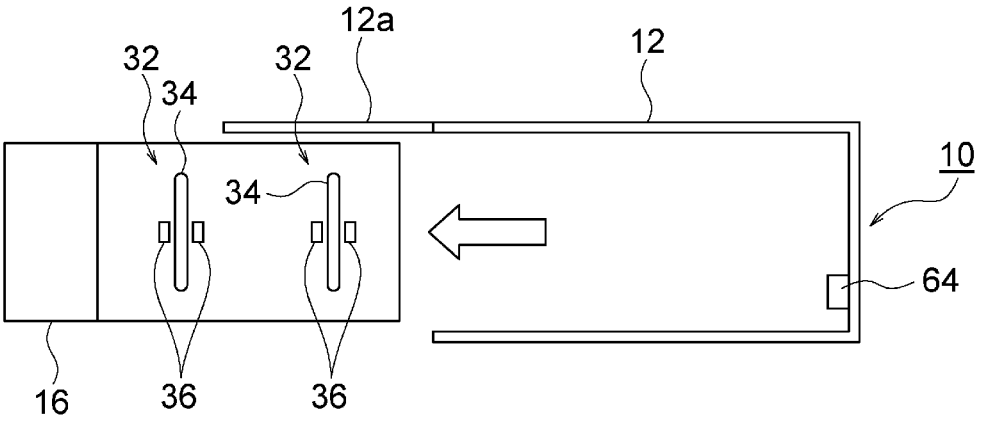
FIG. 6 illustrates an internal structure of the lower assembly in the case of the lower assembly in a state shown in FIG. 5 being drawn forward from the front surface of a housing.

As shown in FIG. 5 and FIG. 6, a door 12*a* being disposed at the lower portion on the front surface of the housing 12 is opened when the lower assembly 16 is drawn outward from the housing 12. The banknote handling machine 10 of the present embodiment includes a door locking unit 64 (see FIG. 7) for locking the door 12*a* in a closed state. In the present embodiment, only a person who has a predetermined authority is allowed to unlock the door locking unit 64 of the door 12*a*, and open the door 12*a*.

When banknotes have been stored the banknote storage bag 34 and before the banknote storage bag 34 of which the opening portion has been heat-sealed (thermally sealed) by the heating member 38 is collected from the banknote handling machine 10, an operator firstly unlocks the door locking unit 64 of the door 12*a* and opens the door 12*a*, as shown in FIG. 5. Subsequently, as shown in FIG. 6, the operator draws the lower assembly 16 forward from the front surface of the housing 12, whereby the operator is allowed to detach the banknote storage bag 34 from each holding member 36 of the banknote storage mechanism 32, to collect the banknote storage bag 34 from the lower assembly 16.

As shown in FIG. 5 and FIG. 6, the banknote handling machine 10 of the present embodiment includes a locking unit 62 that regulates drawing of the lower assembly 16 to the outside of the housing 12. The locking unit 62 is required to regulate drawing of the lower assembly 16 to such that the banknote storage bag 34 held by the holding members 36 cannot be accessed from the outside of the housing 12. For example, the locking unit 62 may lock the lower assembly 16 stored in the housing 12 such that the lower assembly 16 keeps being placed in the housing 12. In a case where the lower assembly 16 is locked in the housing 12 by the locking unit 62, the lower assembly 16 stored in the housing 12 cannot be drawn forward from the front surface of the housing 12 even if the door 12*a* is opened.

In the present embodiment, a regulation unit 60 (see FIG. 7) which selectively regulates access to the banknote storage bag 34 held by the holding members 36 includes the locking unit 62 and/or the door locking unit 64 having the above-described structure. The function of the regulation unit 60 will be described below in detail.

Figure 7:
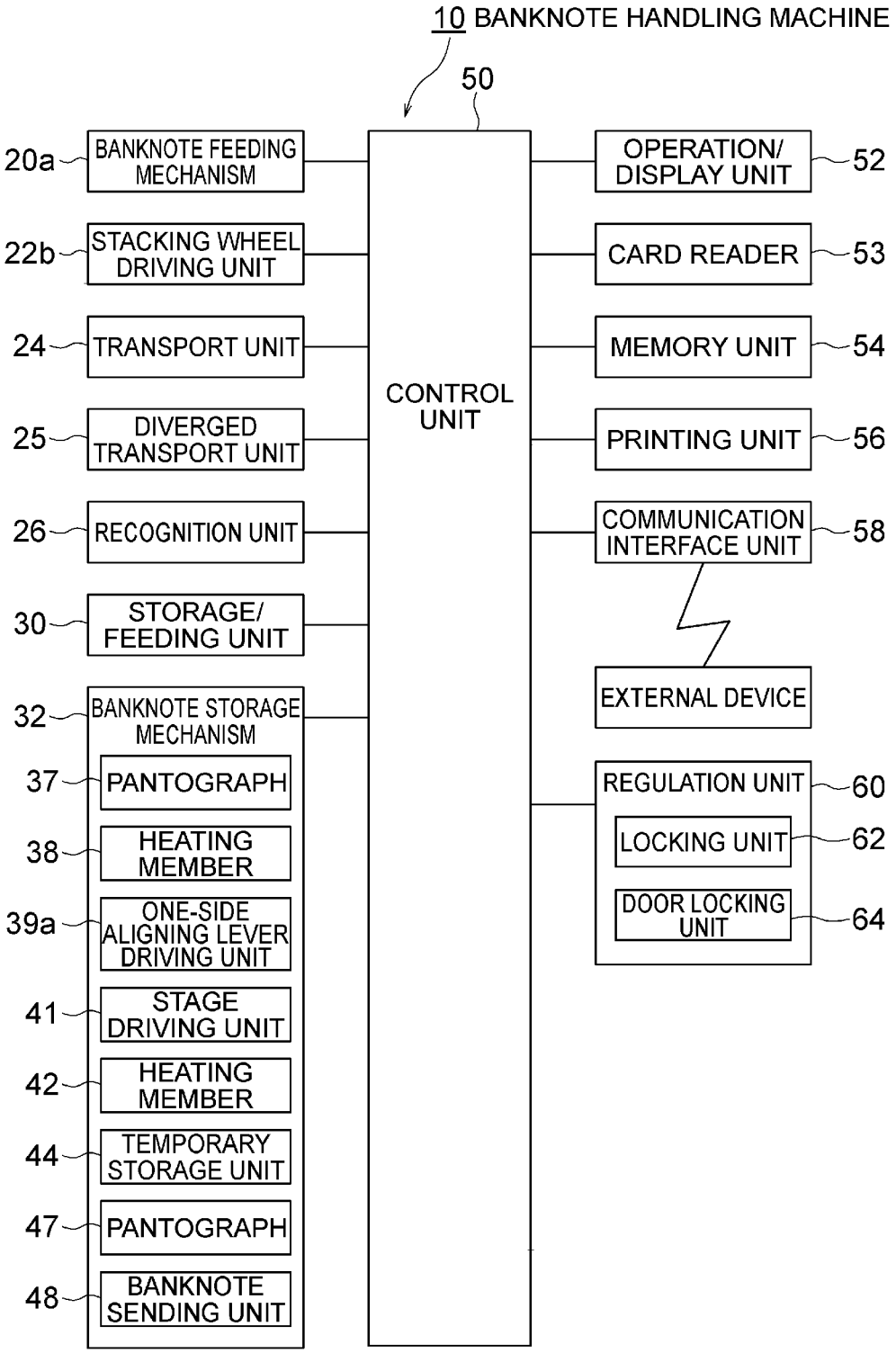

The banknote handling machine 10 of the present embodiment has a control unit 50 that controls the components of the banknote handling machine 10. More specifically, as shown in FIG. 7, the banknote feeding mechanism 20*a* disposed at the inlet unit 20, a stacking wheel driving unit 22*b* for driving the stacking wheel 22*a* disposed at the outlet unit 22, the transport unit 24, the diverged transport unit 25, the recognition unit 26, the storage/feeding unit 30, the banknote storage mechanism 32 (specifically, the pantograph 37, the heating member 38, the one-side aligning lever driving unit 39*a*, the stage driving unit 41, the heating member 42, the temporary storage unit 44, the pantograph 47, and the banknote sending unit 48), and the like, are connected to the control unit 50. A signal representing a result of recognition of a banknote by the recognition unit 26 is transmitted to the control unit 50, and the control unit 50 controls operations of the components by transmitting an instruction signal to each component of the banknote handling machine 10.

As shown in FIG. 7, an operation/display unit 52, a card reader 53, a memory unit 54, a printing unit 56, and a communication interface unit 58 are connected to the control unit 50. As shown in FIG. 1, the operation/display unit 52 is implemented by, for example, a touch panel disposed on the upper surface of the housing 12, and the operation/display unit 52 displays information on, for example, a state of handling such as depositing of banknotes in the banknote handling machine 10, and an inventory amount of banknotes stored in each banknote storage bag 34. When an operator operates the operation/display unit 52, various instructions can be provided to the control unit 50. The card reader 53 reads an ID card of an operator, and thus performs authentication of authority of the operator. The memory unit 54 stores information on, for example, a history of handling such as depositing of banknotes in the banknote handling machine 10, and an inventory amount of banknotes stored in each banknote storage bag 34. The printing unit 56 prints, on a receipt or the like, information on, for example, a history of handling such as depositing of banknotes in the banknote handling machine 10 and an inventory amount of banknotes stored in each banknote storage bag 34. The control unit 50 can transmit a signal to and receive a signal from an external device (specifically, for example, higher-order terminal) disposed separately from the banknote handling machine 10 of the present embodiment, through the communication interface unit 58. Specifically, the control unit 50 can transmit information stored in the memory unit 54 through the communication interface unit 58 to an external device which is disposed separately from the banknote handling machine 10. For example, when the banknotes together with the banknote storage bag 34 are collected by, for example, a guard of a cash-in-transit company, the information on the collected banknotes is transmitted from the control unit 50 to, for example, a computer of the cash-in-transit company through the communication interface unit 58.

As shown in FIG. 7, the regulation unit 60 is connected to the control unit 50. The regulation unit 60 includes, for example, the locking unit 62 and/or the door locking unit 64, and selectively regulates access to the banknote storage bag 34 held by the holding members 36. Specifically, in a case where the regulation unit 60 is the locking unit 62, the locking unit 62 regulates the access to the banknote storage bag 34 held by the holding members 36 because the lower assembly 16 is locked and keeps being placed in the housing 12 by the locking unit 62. In a case where the regulation unit 60 is the door locking unit 64, the door locking unit 64 regulates the access to the banknote storage bag 34 held by the holding members 36 because the door 12*a* is locked in a closed state by the door locking unit 64. In the present embodiment, the control unit 50 controls the regulation unit 60 so as to allow access to the banknote storage bag 34 held by the holding members 36 in a state where the opening portion of the banknote storage bag 34 is opened when a predetermined condition is satisfied. More specifically, the control unit 50 controls the regulation unit 60 so as to allow the banknotes to be stored directly into the banknote storage bag 34 held by the holding members 36 without transporting the banknote through the inlet unit 20, the transport unit 24, and the recognition unit 26, when a predetermined condition is satisfied. Specifically, in a case where the regulation unit 60 is the locking unit 62, when the predetermined condition has been satisfied, the lower assembly 16 stored in the housing 12 is unlocked by the locking unit 62, and the lower assembly 16 can be drawn forward from the front surface of the housing 12. In a case where the regulation unit 60 is the door locking unit 64, when the predetermined condition has been satisfied, the door 12*a* is unlocked by the door locking unit 64, and can be opened. In the present embodiment, the regulation unit 60 may include both the locking unit 62 and the door locking unit 64. Alternatively, the regulation unit 60 of the present embodiment may include one of the locking unit 62 or the door locking unit 64. In the latter case, one of the locking unit 62 or the door locking unit 64 may not be disposed, and only the other thereof may be disposed as the regulation unit 60 in the banknote handling machine 10.

Next, an operation performed by the banknote handling machine 10 described above will be described. The banknote handling machine 10 performs the operation as described below by the control unit 50 controlling the components of the banknote handling machine 10.

Firstly, an operation performed by the banknote handling machine 10 for performing depositing of banknotes will be described. An operator inserts banknotes in the inlet unit 20 and then provides the control unit 50 with an instruction for starting the depositing by using the operation/display unit 52. Then, the banknotes inserted in the inlet unit 20 are taken in into the housing 12, one by one, by the banknote feeding mechanism 20*a*, and transported one by one by the transport unit 24. The recognition unit 26 recognizes a denomination, authenticity, face/back, fitness, new/old series, a transport state, and the like of the banknote transported by the transport unit 24. A banknote recognized as being not normal by the recognition unit 26, that is, a rejected note is transported to the outlet unit 22 by the transport unit 24, and stacked in the outlet unit 22. Thus, the operator is allowed to manually take out the rejected banknotes stacked in the outlet unit 22 from the front surface of the housing 12, and, for example, insert again the banknotes in the inlet unit 20. Meanwhile, a banknote recognized as being normal by the recognition unit 26 is transported to the storage/feeding unit 30, and temporarily stored in the storage/feeding unit 30. The number of the banknotes for each denomination and the total monetary amount of banknotes temporarily stored in the storage/feeding unit 30 are displayed on the operation/display unit 52. When the operator confirms the displayed contents, and performs an operation for accepting the depositing, banknotes are fed out one by one from the storage/feeding unit 30 to the transport unit 24, are diverted from the transport unit 24 to the diverged transport unit 25, are sent from the diverged transport unit 25 to the banknote storage bag 34, and are stored in the banknote storage bag 34.

When the banknote storage bag 34 to which banknotes recognized by the recognition unit 26 is to be transported is in a full state or nearly full state, and no more banknotes recognized by the recognition unit 26 can be stored in the banknote storage bag 34, the storage/feeding unit 30 may store the more banknotes as a storage unit until the full state or the nearly full state is dissolved. Specifically, the banknotes recognized by the recognition unit 26 are transported to the storage/feeding unit 30, and stored in the storage/feeding unit 30. The banknote storage bag 34 in the full state or the nearly full state, is taken out from the banknote storage mechanism 32 of the lower assembly 16 by, for example, a guard of a cash-in-transit company, and an empty banknote storage bag 34 is mounted to the banknote storage mechanism 32. Then, banknotes are fed out one by one from the storage/feeding unit 30 to the transport unit 24, and transported to the banknote storage bag 34 by the transport unit 24.

Next, an operation of storing a banknote transported from the diverged transport unit 25 of the upper assembly 14 to the lower assembly 16, in the banknote storage bag 34 held by the pair of holding members 36, in the banknote storage mechanism 32, will be described.

The banknote transported from the diverged transport unit 25 of the upper assembly 14 to the lower assembly 16 is sent onto the pair of left and right temporary storage units 44 by the banknote sending unit 48, and stacked on the temporary storage units 44. When a predetermined number of banknotes are stacked on each temporary storage unit 44, the each temporary storage unit 44 rotates about the axis of the shaft 44*a* disposed at the end portion in the downward direction (that is, the directions indicated by the arrows in FIG. 2), and the banknotes stacked on the temporary storage units 44 fall from the temporary storage units 44 due to the own weight, and are stored in the banknote storage bag 34. When banknotes fall from the temporary storage units 44, and are stored in the banknote storage bag 34, the stages 40 are moved downward by the stage driving unit 41, and a storage space for storing the banknotes subsequently sent to the banknote storage bag 34 from the temporary storage units 44 is formed in the banknote storage bag 34. In the present embodiment, when banknotes are sent into the banknote storage bag 34 held by the holding members 36 and stored in the banknote storage bag 34, the control unit 50 controls the pantograph 47 so as to press the banknotes temporarily stored in the temporary storage units 44 into inside of the banknote storage bag 34 by the pressing plate 46. Thus, when a banknote is left in the temporary storage units 44, the banknote having been left can be caused to fall from the temporary storage units 44 and stored in the banknote storage bag 34.

After banknotes have been stored in the banknote storage bag 34 held by the holding members 36, and the stages 40 has been moved downward, the control unit 50 may control the pantograph 47 so as to move the pressing plate 46 into the banknote storage bag 34 and press the bottom of the banknote storage bag 34 toward each stage 40 through banknotes stacked in the banknote storage bag 34. In this case, by the banknotes being pressed into the banknote storage bag 34 by the pressing plate 46, the banknotes stacked in the banknote storage bag 34 in a stacked state are compressed in the stacking direction, so that the banknotes stored in the banknote storage bag 34 in the stacked state can be prevented from collapsing.

Next, an operation performed by the banknote handling machine 10 for performing collection of banknotes will be described. When a guard of a cash-in-transit company, or the like collects the banknote storage bag 34 storing banknotes therein, from the banknote handling machine 10, the guard firstly causes the card reader 53 to read her/his ID card. When the ID card of the guard has been read by the card reader 53 to authenticate the authority of the guard, the opening portion of the banknote storage bag 34 held by the holding members 36 in the banknote storage mechanism 32 is heat-sealed (thermally sealed) by the heating members 38. After the opening portion of the banknote storage bag 34 has been sealed, the door 12*a* is unlocked by the door locking unit 64, or the lower assembly 16 in the housing 12 is unlocked by the locking unit 62. Thus, the guard opens the door 12*a* as shown in FIG. 5, and then draws the lower assembly 16 forward from the front surface of the housing 12 as shown in FIG. 6, whereby the banknote storage bag 34 held by the holding members 36 in the banknote storage mechanism 32 can be taken out and collected from the lower assembly 16.

In the banknote handling machine 10 of the present embodiment, banknotes or the like can be inserted directly from outside of the banknote handling machine 10 into the banknote storage bag 34 held by the holding members 36 of the banknote storage mechanism 32, or banknotes or the like can be taken out from the banknote storage bag 34 to outside of the banknote handling machine 10 without transporting the banknotes or the like through the inlet unit 20, the transport unit 24, and the recognition unit 26. Specifically, in a case where the banknote storage bag 34 is held by the holding members 36 of the banknote storage mechanism 32 in a state where the opening portion of the banknote storage bag 34 is opened, a banknote or a sheet (for example, coupon, voucher, check, foreign banknote, and the like which cannot be handled by the upper assembly 14) other than a banknote can be stored directly from outside into the banknote storage bag 34 or a banknote or the like can be taken out from the banknote storage bag 34 by opening the door 12*a* disposed at the lower portion on the front surface of the housing 12 as shown in FIG. 5 and drawing the lower assembly 16 forward from the front surface of the housing 12 as show in FIG. 6.

More specifically, in the present embodiment, when the control unit 50 determines that a predetermined condition has been satisfied, the regulation unit 60 that includes the locking unit 62 and/or the door locking unit 64 releases the regulation of access to the banknote storage bag 34, and the guard is allowed the access to the banknote storage bag 34 held by the holding members 36 in the banknote storage mechanism 32 in a state where the opening portion of the banknote storage bag 34 is opened. As the "predetermined condition", various conditions are preset. For example, based on authority of an operator (specifically, information, of an ID card of the operator, which is read by the card reader 53), external information (specifically, information transmitted from an external device through the communication interface unit 58 to the control unit 50), internal information (specifically, information inputted by an operator through the operation/display unit 52), whether or not the opening portion of the banknote storage bag 34 held by the holding members 36 is to be automatically sealed by the heating members 38 is determined. Such an operation will be described below in detail.

For example, the control unit 50 determines that the predetermined condition has been satisfied in a case where an instruction to insert a sheet such as a banknote directly into the banknote storage bag 34 held by the holding members 36 of the banknote storage mechanism 32 without transporting the sheet through the upper assembly 14 is inputted into the control unit 50. The instruction described above is that an instruction to insert a sheet such as a banknote directly into the banknote storage bag 34 held by the holding members 36 of the banknote storage mechanism 32 without transporting the sheet through the upper assembly 14 (specifically, the inlet unit 20, the transport unit 24, and the recognition unit 26) providing though the operation/display unit 52 by an operator, or a signal relating to an instruction is transmitted from an external device through the communication interface unit 58 to the control unit 50. Specifically, for example, an additional insertion button is displayed on a standby screen of the operation/display unit 52, and, when an operator presses the additional insertion button, the instruction to insert a sheet such as a banknote directly into the banknote storage bag 34 held by the holding members 36 of the banknote storage mechanism 32 without transporting the sheet through the upper assembly 14 is inputted into the control unit 50. when the control unit 50 determines that the predetermined condition has been satisfied, and the regulation unit 60 that includes the locking unit 62 and/or the door locking unit 64 releases the regulation of access to the banknote storage bag 34, the operator is allowed to open the door 12*a*, and draws the lower assembly 16 forward from the front surface of the housing 12. Therefore, a banknote or a sheet other than a banknote can be stored directly into the banknote storage bag 34 held by the holding members 36 in the banknote storage mechanism 32 in a state where the opening portion of the banknote storage bag 34 is opened. Thus, when a banknote is to be additionally stored into the banknote storage bag 34 held by the holding members 36 in the banknote storage mechanism 32 in a state where the opening portion of the banknote storage bag 34 is opened, or a sheet (specifically, coupon or voucher, check, foreign banknote, and the like), other than a banknote, which cannot be handled by the upper assembly 14 is to be stored in the banknote storage bag 34, the sheet such as a banknote can be stored into the banknote storage bag 34 without transporting the sheet through the inlet unit 20, the transport unit 24, and the recognition unit 26 of the upper assembly 14. Meanwhile, when the instruction to insert a sheet such as a banknote directly from outside into the banknote storage bag 34 held by the holding members 36 of the banknote storage mechanism 32 without transporting the sheet through the upper assembly 14 is not inputted to the control unit 50, the regulation unit 60 regulates the access to the banknote storage bag 34, and a sheet such as a banknote cannot be stored directly from outside into the banknote storage bag 34 before the opening portion of the banknote storage bag 34 held by the holding members 36 is sealed by the heating members 38.

When a sheet such as a banknote is stored directly from outside into the banknote storage bag 34 without transporting the sheet through the inlet unit 20, the transport unit 24, and the recognition unit 26 of the upper assembly 14, an operator is allowed to input information on the sheet to the operation/display unit 52. Thus, the control unit 50 can also manage information on the sheet that is stored directly from outside into the banknote storage bag 34 without transporting the sheet through the upper assembly 14. In this case, information on the sheet that is stored directly from outside into the banknote storage bag 34 without transporting the sheet through the inlet unit 20, the transport unit 24, and the recognition unit 26, and information on banknotes that are stored from outside into the banknote storage bag 34 through the inlet unit 20, the transport unit 24, and the recognition unit 26, are managed, by the control unit 50, so as to be distinguished from each other. Specifically, the information on a sheet that is stored directly from outside into the banknote storage bag 34 without transporting the sheet through the inlet unit 20, the transport unit 24, and the recognition unit 26, and the information on banknotes stored into the banknote storage bag 34 through the inlet unit 20, the transport unit 24, and the recognition unit 26, are stored in the memory unit 54 so as to be distinguished from each other. Thus, only information on a sheet such as a banknote that is additionally stored into the banknote storage bag 34 held by the holding members 36 in the banknote storage mechanism 32 in a state where the opening portion of the banknote storage bag 34 is opened, is displayed on, for example, the operation/display unit 52, whereby an operator is allowed to know the information.

In the present embodiment, in a case where, by the predetermined condition having been satisfied, access to the banknote storage bag 34 held by the holding members 36 is allowed in a state where the opening portion of the banknote storage bag 34 is opened, an operator is allowed to input into the control unit 50 an instruction to seal the opening portion of the banknote storage bag 34, through the operation/display unit 52. Thus, until an operator inputs into the control unit 50 an instruction to seal the opening portion of the banknote storage bag 34, a sheet such as a banknote can be stored directly outside into the banknote storage bag 34 without transporting the sheet through the inlet unit 20, the transport unit 24, and the recognition unit 26 of the upper assembly 14. Furthermore, when the predetermined condition is satisfied, and the access to the banknote storage bag 34 held by the holding members 36 is allowed in a state where the opening portion of the banknote storage bag 34 is opened, the banknote storage bag 34 can be collected in the condition that the card reader 53 reads an ID card of a guard of a cash-in-transit company to authenticate authority of the guard, and the opening portion of the banknote storage bag 34 held by the holding members 36 is sealed by each heating member 38.

In the present embodiment, in a case where authority of an operator who is authenticated based on the ID card having been read by the card reader 53 is a predetermined authority (for example, manager, a store manager, or the like of a store), the control unit 50 may determine that the predetermined condition has been satisfied. In this case, when the authority of the operator represents, for example, a manager, a store manager, or the like of the store, such a manager, store manager, or the like is allowed to open the door 12*a* and draw the lower assembly 16 forward from the front surface of the housing 12. Thus, the manager, store manager, or the like is allowed to insert a banknote or a sheet other than a banknote directly from outside into the banknote storage bag 34 held by the holding members 36 in the banknote storage mechanism 32 in a state where the opening portion of the banknote storage bag 34 is opened, or take out a banknote or the like from the banknote storage bag 34 to outside. Meanwhile, in a case where the authority of an operator who is authenticated based on the ID card having been read by the card reader 53 represents an ordinary clerk or the like, the predetermined condition is not satisfied. Therefore, such an ordinary clerk or the like is not allowed to access the banknote storage bag 34 held by each holding member 36 in the banknote storage mechanism 32 in a state where the opening portion of the banknote storage bag 34 is opened. Therefore, removal of a banknote from the banknote storage bag 34 by a malicious clerk or the like can be prevented.

In the present embodiment, an operator may input a temporary time-limited password (one time password) to the operation/display unit 52. In this case, when the time-limited password inputted to the operation/display unit 52 by the operator is correct, the control unit 50 determines that the predetermined condition has been satisfied. In another example, the card reader 53 reads an ID card of each of a plurality of operators, and, when the authorities of the plurality of operators represent a combination of predetermined authorities which have been preset, the control unit 50 may determine that the predetermined condition has been satisfied. Specifically, for example, only when an ID card of each of a manager or store manager of a store and a guard of a cash-in-transit company has been read by the card reader 53, the control unit 50 may determine that the predetermined condition has been satisfied. In this case, only when a plurality of operators having different authorities operate the banknote handling machine 10, the banknote storage bag 34 held by the holding members 36 in the banknote storage mechanism 32 can be accessed in a state where the opening portion of the banknote storage bag 34 is opened, and theft can be more effectively prevented.

In the present embodiment, in a case where access to the banknote storage bag 34 held by each holding member 36 in each banknote storage mechanism 32 is allowed in a state where the opening portion of the banknote storage bag 34 is opened, the opening portion of the banknote storage bag 34 is sealed by the heating members 38 in a manner different from a manner for a case where access to the banknote storage bag 34 is not allowed. Specifically, in a case where access to the banknote storage bag 34 held by the holding members 36 is allowed in a state where the opening portion of the banknote storage bag 34 is opened, when the opening portion of the banknote storage bag 34 is sealed by the heating members 38, a specific character or mark is formed near a portion at which the opening portion of the banknote storage bag 34 is sealed, or the opening portion of the banknote storage bag 34 is sealed at a plurality of portions. In this case, when a guard of a cash-in-transit company, or the like collects the banknote storage bag 34 from the lower assembly 16 of the banknote handling machine 10, the guard or the like can easily know that a sheet such as a banknote may have been additionally stored into the banknote storage bag 34 or a banknote may have been taken out from the banknote storage bag 34. In another example, in a case where an operator inputs, through the operation/display unit 52, information on a sheet such as a banknote that has been stored directly into the banknote storage bag 34 without transporting the sheet through the upper assembly 14 by access to the banknote storage bag 34 held by the holding members 36 being allowed in a state where the opening portion of the banknote storage bag 34 is opened, when the opening portion of the banknote storage bag 34 is sealed by the heating members 38, a character or a mark indicating that a sheet such as a banknote has been stored directly into the banknote storage bag 34 may be formed near a portion at which the opening portion of the banknote storage bag 34 is sealed.

When the opening portion of the banknote storage bag 34 is sealed by the heating members 38, a not-illustrated printing unit may print a code such as a barcode or a two-dimensional code near the opening portion of the banknote storage bag 34. In this case, in a case where access to the banknote storage bag 34 held by each holding member 36 has been allowed in a state where the opening portion of the banknote storage bag 34 is opened, information indicating that access to the banknote storage bag 34 has been allowed may be included in information on the code printed on the banknote storage bag 34. Alternatively, in a case where an operator inputs, through the operation/display unit 52, information on a sheet such as a banknote that has been stored directly into the banknote storage bag 34 without transporting the sheet through the upper assembly 14, information on the sheet stored into the banknote storage bag 34 may be included in information on the code printed on the banknote storage bag 34.

In a case where access to the banknote storage bag 34 held by the holding members 36 in the banknote storage mechanisms 32 is allowed in a state where the opening portion of the banknote storage bag 34 is opened, when the banknote storage bag 34 of which the opening portion is not sealed by the heating members 38 is detached from the holding members 36, a warning message may be displayed on the operation/display unit 52 or a warning sound may be outputted. In this case, in a case where access to the banknote storage bag 34 held by the holding members 36 is allowed, the banknote storage bag 34 can be prevented from being carried away from the lower assembly 16 by a malicious third party.

In the banknote handling machine 10 of the present embodiment, the number of the banknote storage mechanisms 32 disposed is two, and the banknote storage bag 34 is held by the holding members 36 in the banknote storage mechanisms 32. The authority of a store may be allocated to the banknote storage bag 34 corresponding to the first banknote storage mechanism 32, and the authority of a cash-in-transit company may be allocated to the banknote storage bags 34 corresponding to both the banknote storage mechanisms 32. In this case, predetermined conditions corresponding to the two banknote storage bags 34, respectively, held by the holding members 36, are set. More specifically, in a case where the authority of an operator who is authenticated based on the ID card having been read by the card reader 53 represents, for example, a manager, store manager, or the like of the store, the regulation unit 60 releases the regulation of the access to only the banknote storage bag 34 to which the authority of the store is allocated. Thus, when the manager, store manager, or the like of the store inputs, through the operation/display unit 52, an instruction for accessing the banknote storage bag 34 to which the authority of the store is allocated, the door 12*a* is opened and the lower assembly 16 is drawn forward from the front surface of the housing 12, whereby a banknote or the like can be stored directly into the banknote storage bag 34 to which the authority of the store is allocated, or a banknote or the like can be taken out from the banknote storage bag 34. Thus, the manager, store manager, or the like of the store is allowed to perform depositing of the banknotes taken out from the banknote storage bag 34, as change fund, into a money change machine installed at a point-of-sale (POS) register, or replenish an automated teller machine (ATM) with the banknotes. In a case where sheets (for example, voucher or check, coupon, or the like) other than banknotes have been stored in the banknote storage bag 34 in the banknote handling machine 10, the manager, store manager, or the like of the store is allowed to take out such a sheet from the banknote storage bag 34, and perform visual confirmation. In a case where the authority of an operator who is authenticated based on an ID card having been read by the card reader 53 represents, for example, a manager, store manager, or the like of the store, when the operator inputs, through the operation/display unit 52, an instruction for accessing the banknote storage bag 34 to which the authority of the store is allocated, the opening portion of the banknote storage bag 34 to which the authority of the cash-in-transit company is allocated is automatically sealed by the heating members 38. Thus, the manager, store manager, or the like of the store is not allowed to take out banknotes from the banknote storage bag 34 to which the authority of the cash-in-transit company is allocated.

In a case where the authority of an operator who is authenticated based on an ID card having been read by the card reader 53 represents, for example, a guard of a cash-in-transit company, the regulation unit 60 releases the regulation of access to all the banknote storage bags 34. Thus, when the guard of the cash-in-transit company inputs, through the operation/display unit 52, an instruction for accessing the banknote storage bag 34, the door 12*a* is opened and the lower assembly 16 is drawn forward from the front surface of the housing 12, whereby banknotes or the like can be stored directly into all the banknote storage bag 34, or banknotes or the like can be taken out from all the banknote storage bags 34.

In another aspect, in the lower assembly 16, the banknote storage bag 34 to which the authority of the store is allocated is disposed on the front surface side, and the banknote storage bag 34 to which the authority of the cash-in-transit company is allocated is disposed on the far side, and, in a case where the authority of an operator who is authenticated based on an ID card having been read by the card reader 53 represents, for example, the manager, store manager, or the like of the store, when the operator inputs, through the operation/display unit 52, an instruction for accessing the banknote storage bag 34 to which the authority of the store is allocated, only the half portion of the lower assembly 16 may be drawn from the housing 12. Specifically, among the two banknote storage bags 34 held by the holding members 36, the banknote storage bag 34 on the front surface side is exposed outside the housing 12, whereas a position up to which the lower assembly 16 is drawn is regulated by the locking unit 62 such that the banknote storage bag 34 on the far side is left stored in the housing 12. Thus, when only the half portion of the lower assembly 16 can be drawn from the housing 12, the operator is allowed to access the banknote storage bag 34 to which the authority of the store is allocated, whereas the operator is not allowed to access the banknote storage bag 34 to which the authority of the cash-in-transit company is allocated.

In the banknote handling machine 10 of the present embodiment, among the two banknote storage bags 34 disposed in the banknote storage mechanisms 32, respectively, the authority of the cash-in-transit company may be automatically allocated to the banknote storage bag 34 in which the number of stored banknotes is greater, and the authority of the store may be automatically allocated to the banknote storage bag 34 in which the number of stored banknotes is smaller. In this case, when the authority of an operator who is authenticated based on an ID card having been read by the card reader 53 represents, for example, a manager, store manager, or the like of the store, regulation, the regulation unit 60 releases the regulation of access to only the banknote storage bag 34 in which the number of stored banknotes is smaller. Thus, when the manager, store manager, or the like of the store inputs, through the operation/display unit 52, an instruction for accessing the banknote storage bag 34 to which the authority of the store is allocated, the door 12*a* is opened and the lower assembly 16 is drawn forward from the front surface of the housing 12, whereby the banknote storage bag 34 in which the number of stored banknotes is smaller can be accessed. Thus, the manager, store manager, or the like of the store is allowed to insert a sheet (for example, voucher or check, coupon, or the like) other than a banknote directly from outside into the banknote storage bag 34 in which the number of stored banknotes is smaller.

The banknote handling machine 10, according to the present embodiment, having the above-described configuration, includes: the holding members 36 as a holding unit for holding a storage bag in a state where the opening portion of the banknote storage bag 34 is opened or in a state where the opening portion of the banknote storage bag 34 is sealed; the heating members 38 as a sealing unit for sealing the opening portion of the banknote storage bag 34 held by each holding member 36; and the regulation unit 60 for selectively regulating access to the banknote storage bag 34 held by each holding member 36. The control unit 50 controls the regulation unit 60 so as to allow access to the banknote storage bag 34 held by the holding members 36 in a state where the opening portion of the banknote storage bag 34 is opened, when a predetermined condition is satisfied. Thus, when the predetermined condition is satisfied, access to the banknote storage bag 34 held by each holding member 36 is allowed in a state where the opening portion of the banknote storage bag 34 is opened, whereby a sheet such as a banknote can be additionally stored into the banknote storage bag 34 held by the holding members 36 in a state where the opening portion of the banknote storage bag 34 is opened, or a banknote can be taken out from the banknote storage bag 34.

More specifically, in a conventional banknote handling machine, when a banknote storage bag such as a pouch is collected by, for example, a guard of a cash-in-transit company, the opening portion of the banknote storage bag is automatically sealed by a sealing unit. Meanwhile, since before, there has been a request for manually inserting a banknote or a sheet such as a check directly into a banknote storage bag held by each holding member in a state where the opening portion of the banknote storage bag is opened, without transporting the banknote or the sheet through an upper assembly such as an inlet unit, a transport unit, and a recognition unit. However, a conventional banknote handling machine has a problem that such additional insertion of a sheet cannot be performed. When, for example, a guard of a cash-in-transit company collects a banknote storage bag such as a pouch, since a service charge is determined per one banknote storage bag, the store wants to maximize the number of banknotes or the like to be stored in the banknote storage bag. However, a conventional banknote handling machine allows only a guard of a cash-in-transit company, or the like to access the banknote storage bag. Therefore, the request of the store for maximizing the number of banknotes to be stored in the banknote storage bag by manually inserting banknotes cannot be satisfied. Meanwhile, in a case where the banknote storage bag is excessively filled with banknotes, when the opening portion of the banknote storage bag is heat-sealed by each heating member, banknotes near the opening portion of the banknote storage bag are held by each heating member, which causes insufficient sealing of the opening portion of the banknote storage bag. Therefore, a guard of a cash-in-transit company, or the like wants to check a banknote storage bag in advance before the opening portion of the banknote storage bag is sealed, and, when the banknote storage bag is excessively filled with banknotes, the guard wants to take out some of the banknotes from the banknote storage bag. Meanwhile, in the banknote handling machine 10 of the present embodiment, in a case where a predetermined condition has been satisfied, access to the banknote storage bag 34 held by each holding member 36 is allowed in a state where the opening portion of the banknote storage bag 34 is opened, so that the various requests as described above can be satisfied.

In the banknote handling machine 10 of the present embodiment, as described above, at least the holding members 36 are disposed, and the lower assembly 16 is disposed as a drawer unit which is drawn outward from the housing 12, and the regulation unit 60 includes the locking unit 62 that regulates drawing of the lower assembly 16 outward from the housing 12. The locking unit 62 may regulate the lower assembly 16 such that the entirety of the lower assembly 16 is stored in the housing 12. The locking unit 62 may regulate the position of the lower assembly 16 such that the banknote storage bag 34 held by the holding member 36 of the lower assembly 16 cannot be substantially accessed from the outside of the housing 12. The locking unit 62 may be disposed inside the housing 12 or disposed outside the housing 12 to regulate the operation of drawing the lower assembly 16, from the outside of the housing 12. The control unit 50 controls the locking unit 62 so as to allow the lower assembly 16 to be drawn outward from the housing 12 when a predetermined condition has been satisfied. In this case, when the predetermined condition has been satisfied, an operator draws the lower assembly 16 outward from the housing 12, whereby the banknote storage bag 34 held by each holding member 36 that is disposed in the lower assembly 16 in a state where the opening portion of the banknote storage bag 34 is opened can be accessed.

In the banknote handling machine 10 of the present embodiment, as described above, the door 12*a* is disposed in the housing 12 and is opened when the lower assembly 16 as a drawer unit is drawn outward from the housing 12. The regulation unit 60 includes the door locking unit 64 for locking the door 12*a* in a closed state. The control unit 50 controls the door locking unit 64 so as to cancel locking of the door 12*a* in the closed state when a predetermined condition has been satisfied. In this case, when the predetermined condition has been satisfied, an operator opens the door 12*a* and draws the lower assembly 16 outward from the housing 12, whereby the banknote storage bag 34 held by each holding member 36 that is disposed in the lower assembly 16 can be accessed in a state where the opening portion of the banknote storage bag 34 is opened. The door 12*a* may not be disposed on the front surface of the housing 12, and may be disposed on the rear surface or the side surface of the housing 12. A plurality of holding members 36 may be disposed and a plurality of doors 12*a* corresponding to the plurality of holding members 36, respectively, may be separately disposed. As described above, the regulation unit 60 may include both the locking unit 62 and the door locking unit 64. Alternatively, the regulation unit 60 may include one of the locking unit 62 or the door locking unit 64. In the latter case, one of the locking unit 62 or the door locking unit 64 may not be disposed, and only the other thereof may be disposed as the regulation unit 60 in the banknote handling machine 10.

In the banknote handling machine 10 of the present embodiment, as described above, the inlet unit 20 as a taking-in unit for taking in banknotes into the housing 12, the transport unit 24 for transporting banknotes that are taken in into the housing 12 by the inlet unit 20, and the recognition unit 26 for performing recognition of banknotes transported by the transport unit 24 are disposed. The control unit 50 controls the regulation unit 60 so as to allow a sheet such as a banknote to be stored into the banknote storage bag 34 held by each holding member 36 without transporting the sheet through the inlet unit 20, the transport unit 24, and the recognition unit 26, when a predetermined condition has been satisfied. In this case, when a sheet such as a banknote is allowed to be stored into the banknote storage bag 34 held by each holding member 36, an operator is allowed to insert the sheet such as a banknote directly into the banknote storage bag 34 without transporting the sheet through the inlet unit 20, the transport unit 24, and the recognition unit 26.

In the banknote handling machine 10 of the present embodiment, as described above, when an instruction (that is, an instruction for inserting a sheet such as a banknote directly into the banknote storage bag 34) for inserting a sheet such as a banknote into the banknote storage bag 34 held by each holding member 36 without transporting the sheet through the inlet unit 20, the transport unit 24, and the recognition unit 26, is inputted, the control unit 50 determines that the predetermined condition has been satisfied. In this case, an additional insertion button is displayed on the operation/display unit 52, as an instruction unit for providing an instruction for inserting a sheet such as a banknote in the banknote storage bag 34 held by each holding member 36 without transporting the sheet through the inlet unit 20, the transport unit 24, and the recognition unit 26, and, when the additional insertion button is operated, an instruction for inserting a sheet such as a banknote into the banknote storage bag 34 held by each holding member 36 without transporting the sheet through the inlet unit 20, the transport unit 24, and the recognition unit 26, may be inputted into the control unit 50.

In the banknote handling machine 10 of the present embodiment, as described above, information on a sheet such as a banknote that is stored into the banknote storage bag 34 held by each holding member 36 without transporting the sheet through the inlet unit 20, the transport unit 24, and the recognition unit 26, can be inputted to the operation/display unit 52. In this case, the operation/display unit 52 functions as an input unit for inputting information on a sheet such as a banknote that is stored into the banknote storage bag 34 held by each holding member 36 without transporting the sheet through the inlet unit 20, the transport unit 24, and the recognition unit 26. Thus, the control unit 50 can manage information on a sheet such as a banknote that is stored directly into the banknote storage bag 34. According to the present embodiment, information (that is, information on a sheet such as a banknote that is stored directly into the banknote storage bag 34) on a sheet such as a banknote that is stored into the banknote storage bag 34 held by each holding member 36 without transporting the sheet through the inlet unit 20, the transport unit 24, and the recognition unit 26, and information (that is, information on banknotes stored in the banknote storage bag 34 in depositing of the banknotes as described above) on banknotes that are stored into the banknote storage bag 34 held by each holding member 36 through the inlet unit 20, the transport unit 24, and the recognition unit 26 are managed, by the control unit 50, so as to be distinguished from each other.

In the banknote handling machine 10 of the present embodiment, as described above, the card reader 53 is disposed as an authentication unit for performing authentication of authority of an operator, and, when the authority of an operator who is authenticated by the card reader 53 is a predetermined authority, the control unit 50 may determine that the predetermined condition has been satisfied. The authentication unit for performing authentication of the authority of an operator is not limited to the card reader 53. In another aspect, by an operator inputting an identification number and password of the operator to the operation/display unit 52, the authentication of the operator may be performed. In this case, the operation/display unit 52 functions as the authentication unit for performing authentication of the authority of an operator.

In the banknote handling machine 10 of the present embodiment, as described above, a plurality of sets (specifically, two sets) of a pair of holding members 36 are disposed. The predetermined condition corresponding to each of the plurality (specifically, two) of the banknote storage bags 34 held by the holding members 36 is set, and, when the predetermined condition corresponding to the banknote storage bag 34 is satisfied for each of the banknote storage bags 34 held by the respective sets of holding members 36, the control unit 50 controls the regulation unit 60 so as to allow access to the corresponding banknote storage bag 34 held by the holding members 36 in a state where the opening portion of the banknote storage bag 34 is opened. Thus, for example, when the authority of the store is allocated to the first banknote storage bag 34, and the authority of the cash-in-transit company is allocated to the second banknote storage bag 34, a specific operator of the store is allowed to access only the first banknote storage bag 34 to which the authority of the store is allocated.

In the banknote handling machine 10 of the present embodiment, as described above, in a case where access to the banknote storage bag 34 held by each holding member 36 is allowed in a state where the opening portion of the banknote storage bag 34 is opened, each heating member 38 that functions as a sealing unit seals the opening portion of the banknote storage bag 34 in a manner different from a manner for a case where access to the banknote storage bag 34 is not allowed. In this case, when, for example, a guard of a cash-in-transit company collects the banknote storage bag 34 from the lower assembly 16 of the banknote handling machine 10, the guard can easily know that a sheet such as a banknote may have been additionally stored into the banknote storage bag 34, or a banknote may have been taken out from the banknote storage bag 34.

The banknote handling machine 10 of the present embodiment and the banknote handling method performed by the banknote handling machine 10 are not limited to the above-described aspects, and various modifications can be added.

For example, the regulation unit 60 for selectively regulating access to the banknote storage bag 34 held by each holding member 36 is not limited to the locking unit 62 for locking the lower assembly 16 in the housing 12, and/or the door locking unit 64 for locking the door 12*a* in a closed state. A unit, other than the above-described locking unit 62 and/or door locking unit 64, which can selectively regulate access to the banknote storage bag 34 held by each holding member 36 can be used as the regulation unit 60.

A predetermined condition used for determining whether or not access to the banknote storage bag 34 held by each holding member 36 is to be allowed in a state where the opening portion of the banknote storage bag 34 is opened, is not limited to a condition that an instruction for inserting a sheet such as a banknote directly into the banknote storage bag 34 held by each holding member 36 without transporting the sheet through the inlet unit 20, the transport unit 24, and the recognition unit 26, has been inputted, or a condition that authority of an operator who has been authenticated by the authentication unit such as the card reader 53 is a predetermined authority. A condition other than the above-described conditions can be used as the predetermined condition used for determining whether or not access to the banknote storage bag 34 held by each holding member 36 is to be allowed in a state where the opening portion of the banknote storage bag 34 is opened.

Second Embodiment

A second embodiment of the present invention will be described below with reference to the drawings. FIG. 8 to FIG. 18 illustrate a banknote handling machine 110 according to a second embodiment. In the description for the banknote handling machine 110 according to the second embodiment, the same components as described for the banknote handling machine 10 according to the first embodiment are denoted by the same reference numerals, and description thereof is omitted.

Figure 8:
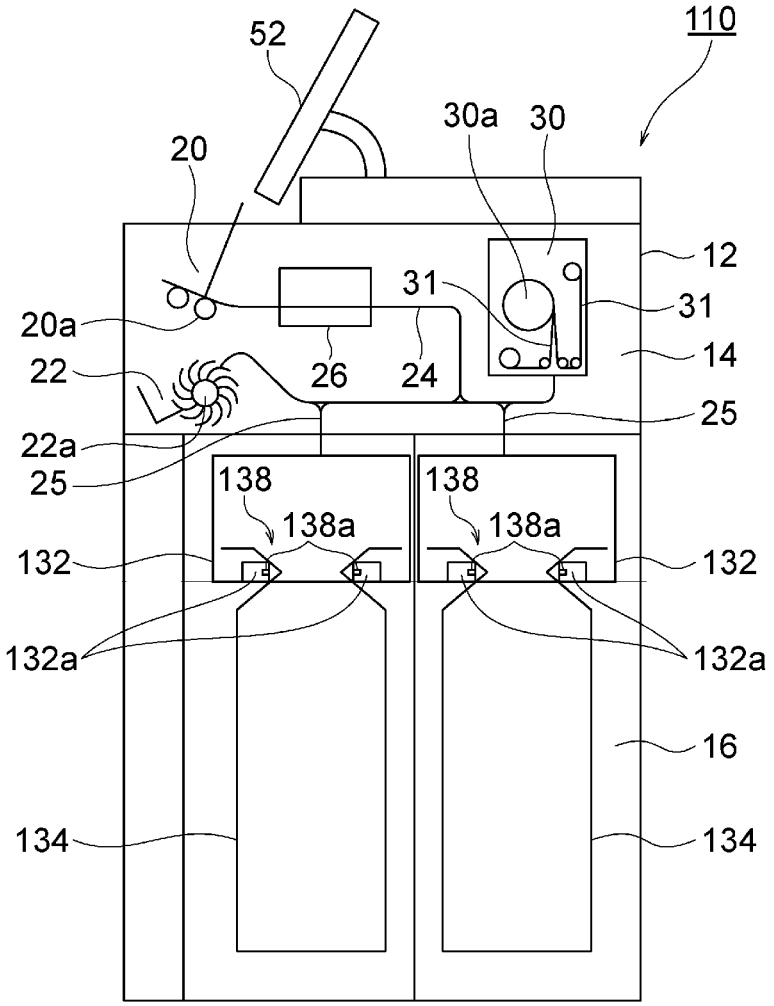
FIG. 8 schematically illustrates an internal structure of a banknote handling machine according to a second embodiment of the present invention.

As shown in FIG. 8, in the banknote handling machine 110 of the present embodiment, the lower assembly 16 includes a plurality (two in the example shown in FIG. 8) of mounting units 132 to which banknote storage bags 134 such as pouches can be mounted. More specifically, the two mounting units 132 are aligned in the lower assembly 16 along a direction (that is, leftward direction in FIG. 8) of drawing of the lower assembly 16 from the housing 12.

Each mounting unit 132 has a pair of holding members 132*a* that are spaced so as to face each other. Two portions, of the banknote storage bag 134, which are near the opening portion of the banknote storage bag 134 and which face each other are held by the holding members 132*a*, respectively. The first holding member 132*a* is fixedly positioned, whereas the second holding member 132*a* can be moved toward the first holding member 132*a* that is fixedly positioned. Each mounting unit 132 is provided with a sealing unit 138 for sealing the opening portion of the banknote storage bag 134 mounted to the mounting unit 132. The sealing unit 138 has a sealing member 138*a* for sealing the opening portion of the banknote storage bag 134 mounted to the mounting unit 132. The sealing member 138*a* seals, by heat, the opening portion of the banknote storage bag 134 mounted to the mounting unit 132. More specifically, the sealing member 138*a* is disposed in each holding member 132*a*. After banknotes are stored in the banknote storage bag 134 mounted to the mounting unit 132, the second holding members 132*a* is moved toward the first holding members 132*a*, and the holding members 132*a* touch each other. In this state, each sealing member 138*a* heats a portion, near the opening portion, of the banknote storage bag 134, whereby the opening portion of the banknote storage bag 134 is heat-sealed (thermally sealed). In each mounting unit 132, instead of the second holding member 132*a* being moved toward the first holding member 132*a*, both the holding members 132*a* may be moved toward each other to touch the holding members 132*a* to each other.

As described below, the sealing unit 138 may have a printing member 138*b* for performing printing on the banknote storage bag 134 mounted to the mounting unit 132, or a marking member 138*c* for marking the banknote storage bag 134 mounted to the mounting unit 132. The sealing unit 138 may include a cutting member 138*d* for partially cutting the banknote storage bag 134 mounted to the mounting unit 132. The cutting member 138*d* forms a hole at a portion, near the opening portion, of the banknote storage bag 134 mounted to the mounting unit 132, or forms a cut portion at an edge of the banknote storage bag 134. Functions of the printing member 138*b*, the marking member 138*c*, and the cutting member 138*d* will be described below in detail. In the present embodiment, the printing member 138*b*, the marking member 138*c*, and the cutting member 138*d* are used as components each of which is a part of the sealing unit 138. However, at least one or the entirety of the printing member 138*b*, the marking member 138*c*, and the cutting member 138*d* may be components separate from the sealing unit 138.

In each mounting unit 132, a temporary storage unit for temporarily holding banknotes transported from the transport unit 24, and a pressing plate for pressing, into the banknote storage bag 134, the banknote that are temporarily stored in the temporary storage unit are disposed above the pair of holding members 132*a*, which are not shown in FIG. 8. Specifically, banknotes transported from the transport unit 24 to each mounting unit 132 are stacked on the temporary storage unit in a stacked state, and, when the banknotes stacked in the temporary storage unit in the stacked state are stored in the banknote storage bag 134, the pressing plate is moved downward and the banknotes stacked in the temporary storage unit are pressed downward and sent into the banknote storage bag 134. When a predetermined number of banknotes are stored in the banknote storage bag 134, the pressing plate is moved downward into the banknote storage bag 134, and the banknotes stored in the banknote storage bag 134 are pressed downward and compressed by the pressing plate.

An operator draws the lower assembly 16 forward (that is, the leftward in FIG. 8) from the front surface of the housing 12, whereby the operator is allowed to detach the banknote storage bag 134 storing the banknotes, from the mounting unit 132, or mount an empty banknote storage bag 134 to the mounting unit 132.

In the upper assembly 14, a plurality (two in the example shown in FIG. 8) of diverged transport units 25 corresponding to the mounting units 132, respectively diverge from the transport unit 24. A banknote that is diverted from the transport unit 24 into the diverged transport unit 25 is sent from the diverged transport unit 25 to the banknote storage bag 134 mounted to each mounting unit 132, and stored in the banknote storage bag 134.

Figure 9:
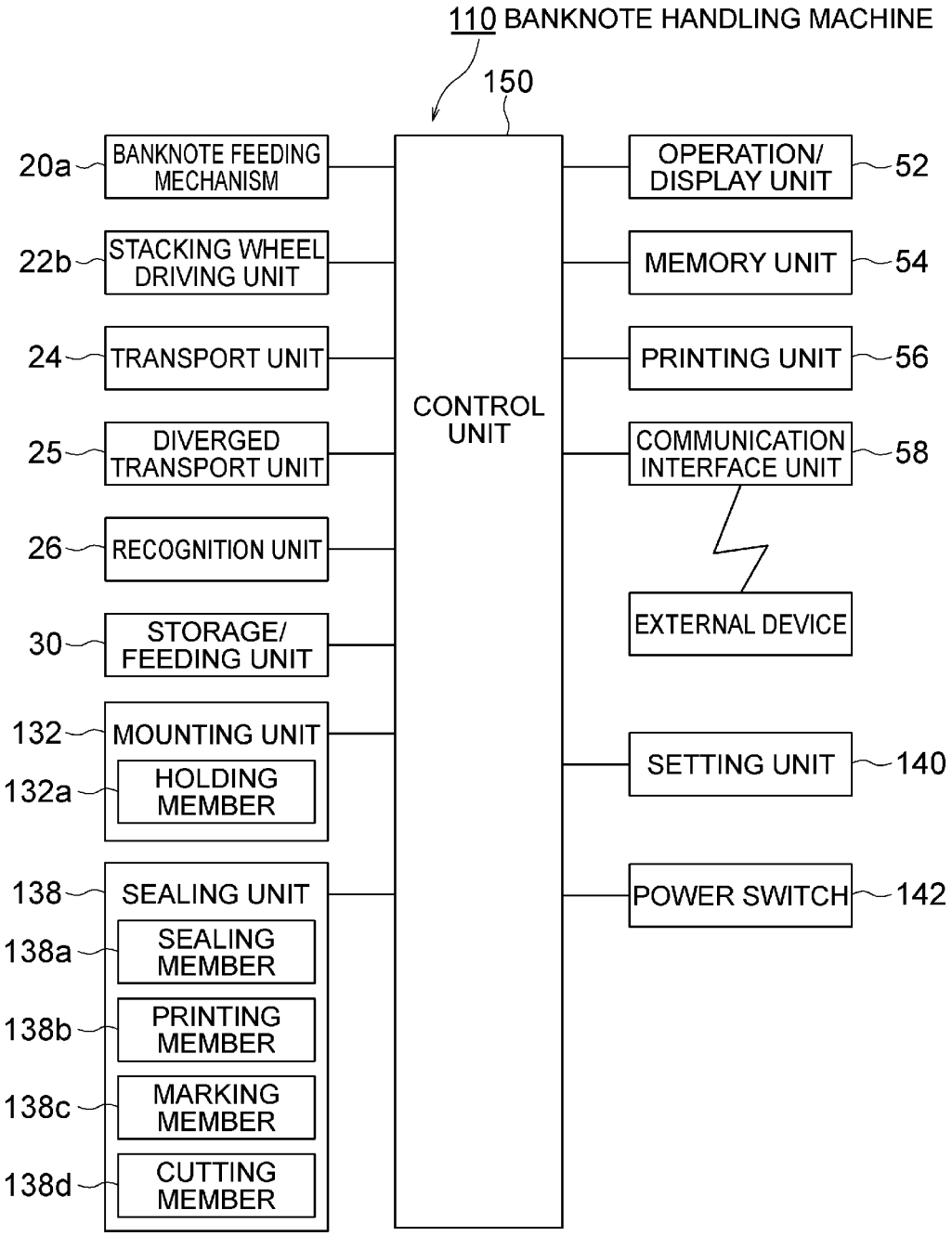
FIG. 9 is a functional block diagram illustrating a configuration of a control system of the banknote handling machine shown in FIG. 8.

The banknote handling machine 110 of the present embodiment includes a control unit 150 that controls the components of the banknote handling machine 110. More specifically, as shown in FIG. 9, the banknote feeding mechanism 20*a* disposed at the inlet unit 20, the stacking wheel driving unit 22*b* for driving the stacking wheel 22*a* disposed at the outlet unit 22, the transport unit 24, the diverged transport unit 25, the recognition unit 26, the storage/feeding unit 30, the mounting unit 132, the sealing unit 138, and the like are connected to the control unit 150. A signal representing a result of recognition of a banknote by the recognition unit 26 is transmitted to the control unit 150, and the control unit 150 controls operations of the components by transmitting an instruction signal to each component of the banknote handling machine 110.

As shown in FIG. 9, the operation/display unit 52, the memory unit 54, the printing unit 56, and the communication interface unit 58 are connected to the control unit 150. As shown in FIG. 8, the operation/display unit 52 is implemented by, for example, a touch panel disposed on the upper surface of the housing 12. The operation/display unit 52 displays information on, for example, a state of handling such as depositing of banknotes in the banknote handling machine 110, and an inventory amount of banknotes stored in each banknote storage bag 134. By an operator operating the operation/display unit 52, the operator is allowed to provide the control unit 150 with various instructions.

The memory unit 54 stores information on, for example, a history of handling such as depositing of banknotes in the banknote handling machine 110, and an inventory amount of banknotes stored in each banknote storage bag 134. The printing unit 56 prints, on a receipt or the like, information on, for example, a history of handling such as depositing of banknotes in the banknote handling machine 110 and an inventory amount of banknotes stored in each banknote storage bag 134. The control unit 150 can transmit a signal to and receive a signal from an external device (specifically, for example, higher-order terminal) disposed separately from the banknote handling machine 110 of the present embodiment, through the communication interface unit 58. For example, when the banknote storage bag 134 is collected by, for example, a guard of a cash-in-transit company, the control unit 150 transmits the information on the banknote storage bag 134 to the cash-in-transit company through the communication interface unit 58.

As shown in FIG. 9, a setting unit 140 for selecting and setting a sealing method for sealing the opening portion of the banknote storage bag 134 from a plurality of sealing methods, based on a result of recognition by the recognition unit 26 is connected to the control unit 150. The function of the setting unit 140 will be described below in detail.

As shown in FIG. 9, a power switch 142 is connected to the control unit 150. The power switch 142 is disposed in the housing 12 of the banknote handling machine 110, and the banknote handling machine 110 operates or stops by an operator setting the power switch 142 to be on or off.

Next, an operation performed by the banknote handling machine 110 having such a configuration will be described. The operation is performed by the banknote handling machine 110 as described below by the control unit 150 controlling each component of the banknote handling machine 110.

Firstly, an operation performed by the banknote handling machine 110 for depositing of banknotes will be described. An operator inserts banknotes in the inlet unit 20 and then provides the control unit 150 with an instruction for starting the depositing by using the operation/display unit 52. Then, the banknotes inserted in the inlet unit 20 are taken in into the housing 12 one by one by the banknote feeding mechanism 20*a*, and transported one by one by the transport unit 24. The recognition unit 26 recognizes a denomination, authenticity, face/back, fitness, new/old series, a transport state, and the like of the banknote transported by the transport unit 24. An image of the banknote is taken by an image sensor of the recognition unit 26, and the serial number of the banknote is obtained based on the image of the banknote. Information on the serial number of the banknote obtained by the recognition unit 26 is stored in the memory unit 54. A banknote recognized as being not normal by the recognition unit 26, that is, a rejected note is transported to the outlet unit 22 by the transport unit 24, and stacked in the outlet unit 22. Thus, for example, the operator is allowed to manually take out the rejected banknotes stacked in the outlet unit 22 from the front surface of the housing 12, and to insert again the banknotes in the inlet unit 20. Meanwhile, banknotes recognized as being normal by the recognition unit 26 are diverted from the transport unit 24 to the diverged transport unit 25, sent from the diverged transport unit 25 to the banknote storage bag 134, and stored in the banknote storage bag 134.

In a case where the banknote storage bag 134 to which a banknote recognized by the recognition unit 26 is to be transported, is in a full state or nearly full state, and the banknote cannot be stored in the banknote storage bag 134, the banknote recognized by the recognition unit 26 is transported to the storage/feeding unit 30, and stored in the storage/feeding unit 30. When the banknote storage bag 134 in the full state or nearly full state is detached from the mounting unit 132 of the lower assembly 16 by, for example, a guard of a cash-in-transit company, or a clerk of a store, and an empty banknote storage bag 134 is mounted to the mounting unit 132, banknotes are fed out one by one from the storage/feeding unit 30 to the transport unit 24, and transported to the banknote storage bag 134 by the transport unit 24.

When the banknote storage bag 134 in the full state or nearly full state is detached from the mounting unit 132 of the lower assembly 16 by, for example, a guard of a cash-in-transit company or a clerk of a store, the opening portion of the banknote storage bag 134 mounted to the mounting unit 132 is sealed by the sealing unit 138. Specifically, the second holding member 132*a* is moved toward the first holding member 132*a*, and the holding members 132*a* touch each other. In this state, each sealing member 138*a* heats a portion, near the opening portion, of the banknote storage bag 134, whereby the opening portion of the banknote storage bag 134 is heat-sealed (thermally sealed).

In the present embodiment, a banknote to be stored in the banknote storage bag 134 mounted to the mounting unit 132 is recognized by the recognition unit 26, and the setting unit 140 selects and sets a sealing method for sealing the opening portion of the banknote storage bag 134 by the sealing unit 138 from a plurality of sealing methods, based on the result of recognition by the recognition unit 26. The control unit 150 controls the sealing unit 138 so as to seal the opening portion of the banknote storage bag 134 mounted to the mounting unit 132, based on the sealing method having been set by the setting unit 140. The memory unit 54 may store correspondence between the sealing method and the result of recognition by the recognition unit 26, and the setting unit 140 may read and set the sealing method corresponding to the result of recognition by the recognition unit 26, from the memory unit 54. Furthermore, the correspondence, stored in the memory unit 54, between the sealing method and the result of recognition by the recognition unit 26, may be changed by input through the operation/display unit 52. Such an operation will be described below in detail.

Figure 10:
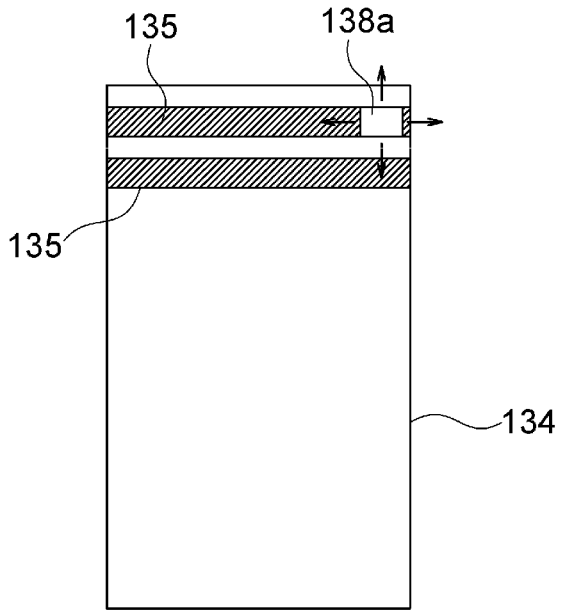
FIG. 10 is a side view showing an example of an operation, performed by a sealing unit, for sealing an opening portion of a banknote storage bag mounted to a mounting unit in the banknote handling machine shown in FIG. 8.
Figure 11:
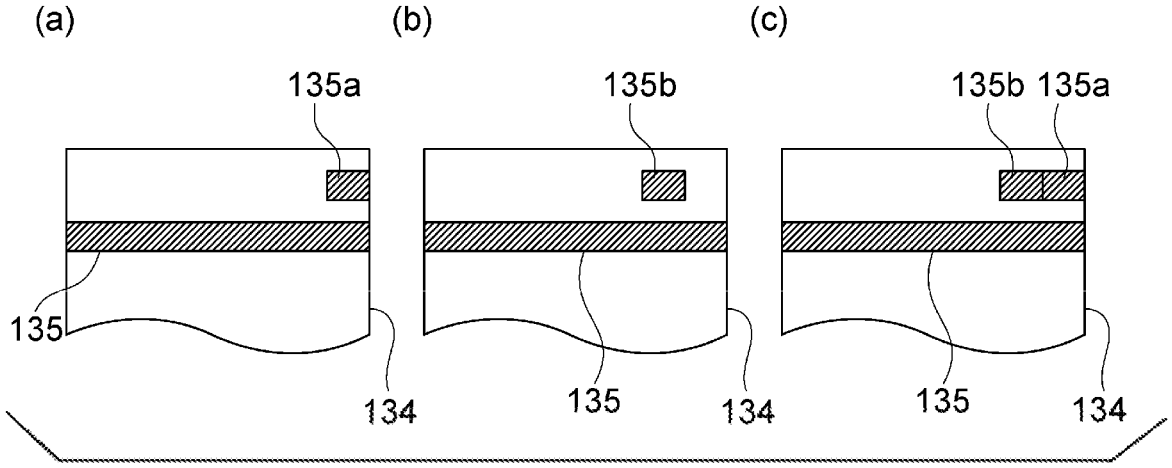
FIG. 11 is a side view showing another example of an operation, performed by the sealing unit, for sealing an opening portion of a banknote storage bag mounted to the mounting unit in the banknote handling machine shown in FIG. 8.

The setting unit 140 selects and sets a portion, of the banknote storage bag 134 mounted to the mounting unit 132, to be sealed by the sealing member 138*a*, from a plurality of portions, in the sealing method for sealing the opening portion of the banknote storage bag 134, based on the result of recognition by the recognition unit 26. The control unit 150 controls the sealing member 138*a* of the sealing unit 138 so as to seal the banknote storage bag 134 mounted to the mounting unit 132 at the portion having been set by the setting unit 140. Such an operation will be described with reference to FIG. 10. As shown in FIG. 10, the sealing member 138*a* is movable relative to the banknote storage bag 134 mounted to the mounting unit 132, in the up-down direction and the left-right direction shown in FIG. 10. Portions, of the banknote storage bag 134 mounted to the mounting unit 132, to be sealed by the sealing member 138*a* of the sealing unit 138 are indicated as diagonal line regions represented by reference numeral 135 in FIG. 10. In the present embodiment, the sealing member 138*a* of the sealing unit 138 may seal the opening portion of the banknote storage bag 134 at one portion over the entire width of the banknote storage bag 134 (that is, the opening portion of the banknote storage bag 134 may be sealed at only one of the two sealing portions represented by reference numeral 135 in FIG. 10), or may seal the opening portion of the banknote storage bag 134 at two portions over the entire width of the banknote storage bag 134 (that is, the opening portion of the banknote storage bag 134 may be sealed at the two sealing portions represented by reference numeral 135 in FIG. 10). The setting unit 140 determines, for setting, whether the sealing member 138*a* of the sealing unit 138 seals the opening portion of the banknote storage bag 134 at one portion or two portions over the entire width of the banknote storage bag 134, based on result of recognition by the recognition unit 26. More specifically, in a case where the number or a monetary amount of banknotes that are stored in the banknote storage bag 134 mounted to the mounting unit 132 has been accepted (that is, in a case where the inventory amount of banknotes that are stored in the banknote storage bag 134 mounted to the mounting unit 132 is in an accepted state), based on the result of recognition by the recognition unit 26, the setting unit 140 performs setting such that the sealing member 138*a* of the sealing unit 138 seals the opening portion of the banknote storage bag 134 at one portion over the entire width of the banknote storage bag 134. Meanwhile, in a case where the number or a monetary amount of banknotes that are stored in the banknote storage bag 134 mounted to the mounting unit 132 has not been accepted (that is, in a case where an inventory amount of banknotes that are stored in the banknote storage bag 134 mounted to the mounting unit 132 is in an unaccepted state), based on the result of recognition by the recognition unit 26, the setting unit 140 performs setting such that the sealing member 138*a* of the sealing unit 138 seals the opening portion of the banknote storage bag 134 at two portions over the entire width of the banknote storage bag 134. Thus, in a case where the number or a monetary amount of banknotes that are stored in the banknote storage bag 134 mounted to the mounting unit 132 has been accepted, the sealing member 138*a* of the sealing unit 138 seals the opening portion of the banknote storage bag 134 mounted to the mounting unit 132 at one portion over the entire width thereof. Meanwhile, in a case where the number or a monetary amount of banknotes that are stored in the banknote storage bag 134 mounted to the mounting unit 132 has not been accepted, the sealing member 138*a* of the sealing unit 138 seals the opening portion of the banknote storage bag 134 mounted to the mounting unit 132 at two portions over the entire width thereof. Thus, an operator can easily know whether or not the number or a monetary amount of banknotes stored in the banknote storage bag 134 has been accepted, by simply looking at the outer appearance of the banknote storage bag 134.

According to the present embodiment, in the banknote handling machine 110, when depositing of banknotes is performed, an operator is allowed to set, through the operation/display unit 52, a forcible depositing mode for forcibly storing, in the banknote storage bag 134, a banknote which cannot be specified for the denomination based on a result of recognition by the recognition unit 26. In a case where such a forcible depositing mode is set, when a banknote which cannot be specified for the denomination based on the result of recognition by the recognition unit 26 is forcibly stored in the banknote storage bag 134, the number or a monetary amount of banknotes that are stored in the banknote storage bag 134 mounted to the mounting unit 132 is in an unaccepted state. In a case where depositing of banknotes is performed in the banknote handling machine 110, when abnormality in transporting a banknote in the transport unit 24 occurs and the handling performed by the banknote handling machine 110 stops, whether or not a banknote which is just about to be stored in the banknote storage bag 134 or a banknote which is being stored in the banknote storage bag 134 has been stored in the banknote storage bag 134 cannot be determined. Also in this case, the number or a monetary amount of banknotes that are stored in the banknote storage bag 134 mounted to the mounting unit 132 is in an unaccepted state.

The sealing member 138*a* of the sealing unit 138 may seal the opening portion of the banknote storage bag 134 at one portion over the entire width of the banknote storage bag 134 mounted to the mounting unit 132 and additionally seal a portion above the sealing portion over the entire width of the banknote storage bag 134, depending on the result of recognition by the recognition unit 26. Such an operation will be described with reference to (a) to (c) of FIG. 11. In (a) to (c) of FIG. 11, portions, of the banknote storage bag 134 mounted to the mounting unit 132, to be sealed by the sealing member 138*a* of the sealing unit 138 are indicated as diagonal line regions represented by reference numerals 135, 135*a*, and 135*b*. In a case where the number or a monetary amount of banknotes that are stored in the banknote storage bag 134 mounted to the mounting unit 132 has not been accepted (that is, in a case where an inventory amount of banknotes that are stored in the banknote storage bag 134 mounted to the mounting unit 132 is in an unaccepted state), based on the result of recognition by the recognition unit 26, the setting unit 140 performs setting such that the sealing member 138*a* of the sealing unit 138 seals the banknote storage bag 134 at portions represented by reference numeral 135 and reference numeral 135*a*, as shown in (a) of FIG. 11. In a case where the number or a monetary amount of banknotes that are stored in the banknote storage bag 134 mounted to the mounting unit 132 is greater than a predetermined number or a predetermined monetary amount having been preset, according to the result of recognition by the recognition unit 26, the setting unit 140 performs setting such that the sealing member 138*a* of the sealing unit 138 seals the banknote storage bag 134 at portions represented by reference numeral 135 and reference numeral 135*b*, as shown in (b) of FIG. 11. In a case where at least one banknote other than a genuine banknote is included in banknotes that are stored in the banknote storage bag 134 mounted to the mounting unit 132, according to the result of recognition by the recognition unit 26, the setting unit 140 performs setting such that the sealing member 138*a* of the sealing unit 138 seals the banknote storage bag 134 at portions represented by reference numeral 135, reference numeral 135*a*, and reference numeral 135*b*, as shown in (c) of FIG. 11. In a case where a state of banknotes that are stored in the banknote storage bag 134 mounted to the mounting unit 132 does not correspond to any of the above-described states, according to the result of recognition by the recognition unit 26, the setting unit 140 performs setting such that the sealing member 138*a* of the sealing unit 138 seals the banknote storage bag 134 at only a portion represented by reference numeral 135 in FIG. 11. Thus, an operator can easily know information on the banknotes stored in the banknote storage bag 134 by simply looking at the outer appearance of the banknote storage bag 134.

In the present embodiment, the upper limit of the number or a monetary amount of banknotes stored in the banknote storage bag 134 is preset by the control unit 150. In a case where the number or a monetary amount of banknotes that are stored in the banknote storage bag 134 mounted to the mounting unit 132 is greater than the above-described upper limit, of the number or a monetary amount of the banknotes, which is preset by the control unit 150, the setting unit 140 performs setting such that the sealing member 138*a* of the sealing unit 138 seals the banknote storage bag 134 at the portions represented by reference numeral 135 and reference numeral 135*b*, as shown in (b) of FIG. 11. Alternatively, when a monetary amount (for example, maximum insurance coverage) which is set for security in the case of the banknote storage bag 134 being detached and carried from the banknote handling machine 110, is preset by the control unit 150, if a monetary amount of banknotes that are stored in the banknote storage bag 134 mounted to the mounting unit 132 is greater than the monetary amount of banknotes which has been preset by the control unit 150, the setting unit 140 may perform setting such that the sealing member 138*a* of the sealing unit 138 seals the banknote storage bag 134 at the portions represented by reference numeral 135 and reference numeral 135*b*, as shown in (b) of FIG. 11.

In the present embodiment, not only in a case where banknotes that are stored in the banknote storage bag 134 mounted to the mounting unit 132 include a counterfeit note, but also in a case where banknotes that are stored in the banknote storage bag 134 mounted to the mounting unit 132 include a banknote of which the authenticity is suspected (hereinafter, such a banknote is also referred to as suspect note), or in a case where banknotes that are stored in the banknote storage bag 134 mounted to the mounting unit 132 include a medium (for example, voucher or check) determined as being not a banknote, it is determined that the banknotes that are stored in the banknote storage bag 134 mounted to the mounting unit 132 include a banknote other than a genuine banknote. Also in a case where the banknotes that are stored in the banknote storage bag 134 mounted to the mounting unit 132 include a banknote which has been issued by a foreign country or organization, or an old series note, it may be determined that banknotes that are stored in the banknote storage bag 134 mounted to the mounting unit 132 include a banknote other than a genuine banknote.

Figure 12:
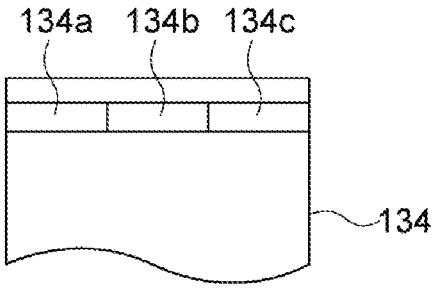
FIG. 12 is a side view showing still another example of an operation, performed by the sealing unit, for sealing an opening portion of a banknote storage bag mounted to the mounting unit in the banknote handling machine shown in FIG. 8.

In the sealing method for sealing the opening portion of the banknote storage bag 134 in which the setting unit 140 sets a portion, of the banknote storage bag 134 mounted to the mounting unit 132, to be sealed by the sealing member 138*a*, based on the result of recognition by the recognition unit 26, a plurality of heat-sensitive light emission layers having different colors, respectively, may be disposed in the banknote storage bag 134 to be mounted to the mounting unit 132. When the setting unit 140 sets a portion, of the banknote storage bag 134 mounted to the mounting unit 132, to be sealed by the sealing member 138*a*, a heat-sensitive light emission layer to be sealed by the sealing member 138*a* may be selected and set from the plurality of heat-sensitive light emission layers disposed on the banknote storage bag 134, based on the result of recognition by the recognition unit 26. Such an operation will be described with reference to FIG. 12. As shown in FIG. 12, near the opening portion of the banknote storage bag 134, a first heat-sensitive light emission layer 134*a* that emits red light when heat-sealed by the sealing member 138*a*, a second heat-sensitive light emission layer 134*b* that emits blue light when heat-sealed by the sealing member 138*a*, and a third heat-sensitive light emission layer 134*c* that emits yellow light when heat-sealed by the sealing member 138*a* are formed so as to be aligned along the width direction of the banknote storage bag 134. When a portion, of the banknote storage bag 134 mounted to the mounting unit 132, to be sealed by the sealing member 138*a* is set, the setting unit 140 selects and sets a heat-sensitive light emission layer to be sealed by the sealing member 138*a* from the three heat-sensitive light emission layers 134*a* to 134*c* based on the result of recognition by the recognition unit 26, in addition to the opening portion of the banknote storage bag 134 being sealed at one portion over the entire width of the banknote storage bag 134 mounted to the mounting unit 132. Thus, the color of light emitted by the heat-sensitive light emission layer disposed near the opening portion of the banknote storage bag 134 is different depending on a state of banknotes that are stored in the banknote storage bag 134 mounted to the mounting unit 132, and an operator can easily know information on the banknotes stored in the banknote storage bag 134 by simply looking at the color of light emitted by the heat-sensitive light emission layer near the opening portion of the banknote storage bag 134.

Figure 13:
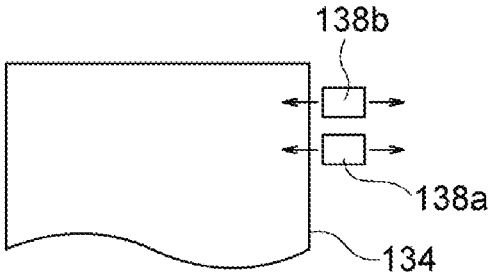
FIG. 13 is a side view showing still another example of an operation, performed by the sealing unit, for sealing an opening portion of a banknote storage bag mounted to the mounting unit in the banknote handling machine shown in FIG. 8.

In a case where the sealing unit 138 has the sealing member 138*a* and the printing member 138*b*, the setting unit 140 may set a content to be printed on the banknote storage bag 134 by the printing member 138*b*, based on the result of recognition by the recognition unit 26, in the sealing method for sealing the opening portion of the banknote storage bag 134, and the control unit 150 may control the printing member 138*b* of the sealing unit 138 so as to perform printing on the banknote storage bag 134 mounted to the mounting unit 132 based on the content, to be printed, which is set by the setting unit 140. Such an operation will be described with reference to FIG. 13. In the present embodiment, a printer such as an inkjet printer is used as the printing member 138*b*. As shown in FIG. 13, the sealing member 138*a* and the printing member 138*b* are movable relative to the banknote storage bag 134 mounted to the mounting unit 132 in the left-right direction shown in FIG. 13. The sealing member 138*a* of the sealing unit 138 seals the opening portion of the banknote storage bag 134 at one portion over the entire width of the banknote storage bag 134 mounted to the mounting unit 132. The printing member 138*b* prints various characters at a portion above the portion, of the banknote storage bag 134, which has been sealed by the sealing member 138*a*. Specifically, in a case where the number or a monetary amount of the banknotes that are stored in the banknote storage bag 134 mounted to the mounting unit 132 has not been accepted, based on the result of recognition by the recognition unit 26, the setting unit 140 performs setting such that the printing member 138*b* prints characters representing "abnormality in inventory amount" on the banknote storage bag 134. In a case where the banknotes that are stored in the banknote storage bag 134 mounted to the mounting unit 132 include at least one banknote (for example, counterfeit note or suspect note) other than a genuine banknote, according to the result of recognition by the recognition unit 26, the setting unit 140 performs setting such that the printing member 138*b* prints characters representing "include a suspect note" on the banknote storage bag 134. Thus, an operator can easily know information on the banknotes stored in the banknote storage bag 134 by simply looking at the characters printed on the banknote storage bag 134.

In the present embodiment, the printing member 138*b* may print various characters at a portion, of the banknote storage bag 134 mounted to the mounting unit 132, which has been sealed by the sealing member 138*a*, instead of various characters being printed at a portion above a portion, of the banknote storage bag 134 mounted to the mounting unit 132, which has been sealed by the sealing member 138*a*. Specifically, the sealing member 138*a* and the printing member 138*b* may be integrated with each other.

Figure 14:
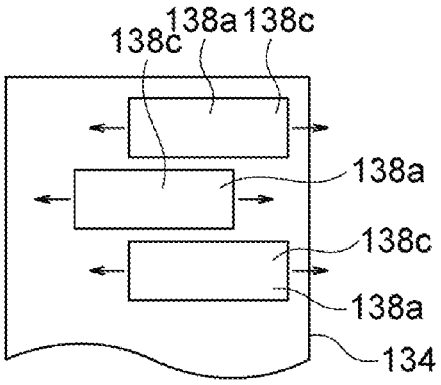
FIG. 14 is a side view showing still another example of an operation, performed by the sealing unit, for sealing an opening portion of a banknote storage bag mounted to the mounting unit in the banknote handling machine shown in FIG. 8.

In a case where the sealing unit 138 has the sealing member 138*a* and the marking member 138*c*, the setting unit 140 may set a content to be marked on the banknote storage bag 134 by the marking member 138*c*, based on the result of recognition by the recognition unit 26, in the sealing method for sealing the opening portion of the banknote storage bag 134, and the control unit 150 may control the marking member 138*c* of the sealing unit 138 such that the banknote storage bag 134 mounted to the mounting unit 132 is marked based on the content, to be marked, which has been set by the setting unit 140. Such an operation will be descried with reference to FIG. 14. As shown in FIG. 14, a plurality (three in the example shown in FIG. 14) of the marking members 138*c* are disposed along the height direction of the banknote storage bag 134 mounted to the mounting unit 132, and the marking members 138*c* each include the sealing member 138*a*. That is, three members each of which has the sealing member 138*a* and the marking member 138*c* integrated with each other, are disposed. Each marking member 138*c* is movable relative to the banknote storage bag 134 mounted to the mounting unit 132 in the left-right direction shown in FIG. 14. The sealing member 138*a* of the sealing unit 138 seals the opening portion of the banknote storage bag 134 at one portion over the entire width of the banknote storage bag 134 mounted to the mounting unit 132. Each marking member 138*c* marks a portion, of the banknote storage bag 134, which has been sealed by the sealing member 138*a*, with various characters. Among the three marking members 138*c*, the marking member 138*c* disposed on the uppermost side marks the banknote storage bag 134 with characters representing "abnormality in inventory amount". Among the three marking members 138*c*, the marking member 138*c* disposed at the second highest position marks the banknote storage bag 134 with characters representing "include suspect note". Among the three marking members 138*c*, the marking member 138*c* disposed on the lowermost side marks the banknote storage bag 134 with characters representing "exceed storage capacity". In a case where the number or a monetary amount of banknotes that are stored in the banknote storage bag 134 mounted to the mounting unit 132 has not been accepted, based on the result of recognition by the recognition unit 26, the setting unit 140 performs setting such that the sealing member 138*a* and the marking member 138*c* disposed on the uppermost side seals and marks the banknote storage bag 134 mounted to the mounting unit 132. In a case where banknotes that are stored in the banknote storage bag 134 mounted to the mounting unit 132 include at least one banknote (for example, counterfeit note or suspect note) other than a genuine banknote, according to the result of recognition by the recognition unit 26, the setting unit 140 performs setting such that the sealing member 138*a* and the marking member 138*c* disposed at the second highest position seal and mark the banknote storage bag 134 mounted to the mounting unit 132. In a case where the number or a monetary amount of banknotes that are stored in the banknote storage bag 134 mounted to the mounting unit 132 is greater than a predetermined number or a predetermined monetary amount having been preset, according to the result of recognition by the recognition unit 26, the setting unit 140 performs setting such that the sealing member 138*a* and the marking member 138*c* disposed on the lowermost side seal and mark the banknote storage bag 134 mounted to the mounting unit 132. Thus, an operator can easily know information on the banknotes stored in the banknote storage bag 134 by simply looking at characters marked on the banknote storage bag 134.

Figure 15:
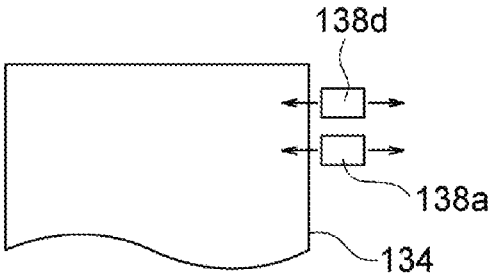
FIG. 15 is a side view showing still another example of an operation, performed by the sealing unit, for sealing an opening portion of a banknote storage bag mounted to the mounting unit in the banknote handling machine shown in FIG. 8.
Figure 16:
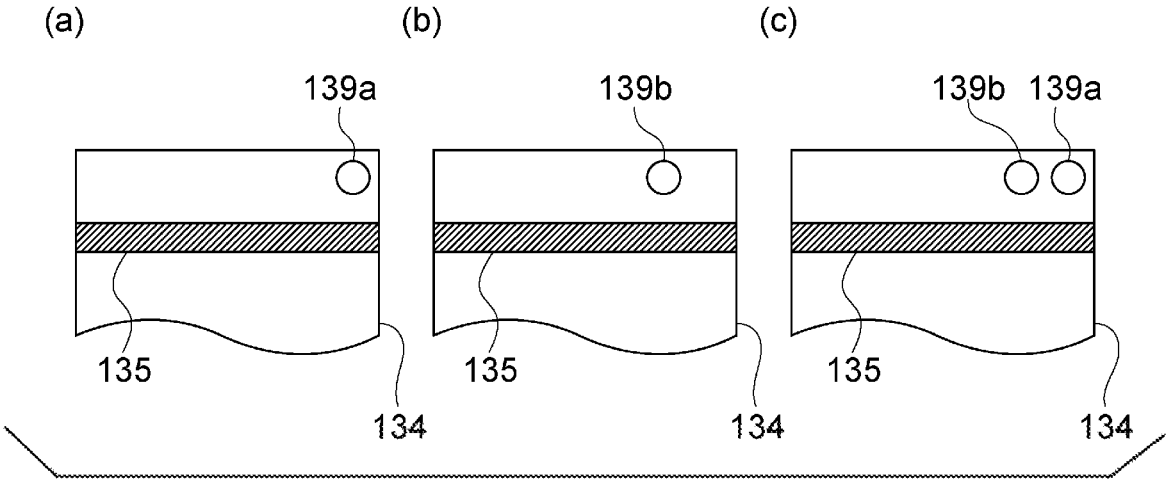
FIG. 16 is a side view showing still another example of an operation, performed by the sealing unit, for sealing an opening portion of a banknote storage bag mounted to the mounting unit in the banknote handling machine shown in FIG. 8.

In a case where the sealing unit 138 has the sealing member 138*a* and the cutting member 138*d*, the setting unit 140 may set a portion, of the banknote storage bag 134 mounted to the mounting unit 132, to be cut by the cutting member 138*d*, based on the result of recognition by the recognition unit 26, in the sealing method for sealing the opening portion of the banknote storage bag 134, and the control unit 150 may control the cutting member 138*d* of the sealing unit 138 so as to cut the banknote storage bag 134 mounted to the mounting unit 132, at the portion having been set by the setting unit 140. Such an operation will be described with reference to FIG. 15 and FIG. 16. In the example shown in FIG. 15 and FIG. 16, the cutting member 138*d* forms a hole near the opening portion of the banknote storage bag 134 mounted to the mounting unit 132. As shown in FIG. 15, the sealing member 138*a* and the cutting member 138*d* are movable relative to the banknote storage bag 134 mounted to the mounting unit 132 in the left-right direction in FIG. 15 and FIG. 16. The sealing member 138*a* of the sealing unit 138 seals the opening portion of the banknote storage bag 134 at one portion over the entire width of the banknote storage bag 134 mounted to the mounting unit 132. In FIG. 16, a portion, of the banknote storage bag 134 mounted to the mounting unit 132, to be sealed by the sealing member 138*a* of the sealing unit 138 is indicated as a diagonal line region represented by reference numeral 135. The cutting member 138*d* forms a hole in the banknote storage bag 134 at a portion above the portion, of the banknote storage bag 134, which has been sealed by the sealing member 138*a*. In (a) to (c) of FIG. 16, portions, of the banknote storage bag 134 mounted to the mounting unit 132, at which holes are formed by the cutting member 138*d* are represented by reference numerals 139*a*, 139*b*. In a case where the number or a monetary amount of banknotes that are stored in the banknote storage bag 134 mounted to the mounting unit 132 has not been accepted, based on the result of the recognition by the recognition unit 26 (that is, in a case where an inventory amount of banknotes that are stored in the banknote storage bag 134 mounted to the mounting unit 132 is in an unaccepted state), the setting unit 140 performs setting such that the cutting member 138*d* of the sealing unit 138 forms a hole at a portion, represented by reference numeral 139*a*, of the banknote storage bag 134, as shown in (a) of FIG. 16. In a case where the number or a monetary amount of banknotes that are stored in the banknote storage bag 134 mounted to the mounting unit 132 is greater than a predetermined number or a predetermined monetary amount having been preset, according to the result of recognition by the recognition unit 26, the setting unit 140 performs setting such that the cutting member 138*d* of the sealing unit 138 forms a hole at a portion, represented by reference numeral 139*b*, of the banknote storage bag 134, as shown in (b) of FIG. 16. In a case where banknotes stored in the banknote storage bag 134 mounted to the mounting unit 132 include a counterfeit note, according to the result of recognition by the recognition unit 26, the setting unit 140 performs setting such that the cutting member 138*d* of the sealing unit 138 forms holes at portions, represented by reference numeral 139*a* and reference numeral 139*b*, of the banknote storage bag 134, as shown in (c) of FIG. 16. In a case where a state of banknotes stored in the banknote storage bag 134 mounted to the mounting unit 132 does not correspond to any of the above-described states according to the result of recognition by the recognition unit 26, the setting unit 140 performs setting such that the cutting member 138*d* of the sealing unit 138 does not form a hole in the banknote storage bag 134. Thus, an operator can easily know information on banknotes stored in the banknote storage bag 134 by simply looking at the hole formed near the opening portion of the banknote storage bag 134.

As described above, in the present embodiment, in a case where the number or a monetary amount of banknotes that are stored in the banknote storage bag 134 mounted to the mounting unit 132 has not been accepted based on the result of recognition by the recognition unit 26, the setting unit 140 sets the sealing method for sealing the opening portion of the banknote storage bag 134 such that the sealing method is different from a sealing method in a case where the number or a monetary amount of banknotes that are stored in the banknote storage bag 134 mounted to the mounting unit 132 has been accepted. In a case where the number or a monetary amount of banknotes that are stored in the banknote storage bag 134 mounted to the mounting unit 132 is greater than a predetermined number or a predetermined monetary amount having been preset, according to the result of recognition by the recognition unit 26, the setting unit 140 sets the sealing method for sealing the opening portion of the banknote storage bag 134 such that the sealing method is different from a sealing method in a case where the number or a monetary amount of banknotes that are stored in the banknote storage bag 134 mounted to the mounting unit 132 is less than or equal to the predetermined number or the predetermined monetary amount having been preset. In a case where at least one banknote stored in the banknote storage bag 134 mounted to the mounting unit 132 is not a genuine banknote, according to the result of recognition by the recognition unit 26, the setting unit 140 sets the sealing method for sealing the opening portion of the banknote storage bag 134 such that the sealing method is different from a sealing method in a case where all the banknotes that are stored in the banknote storage bag 134 mounted to the mounting unit 132 are genuine banknotes. Setting, by the setting unit 140, of the sealing method for sealing the opening portion of the banknote storage bag 134 is not limited to the above-described aspect. In another aspect, the setting unit 140 may select and set a sealing method, for sealing an opening portion of a storage bag, corresponding to the number or a monetary amount of banknotes that are stored in the banknote storage bag 134 mounted to the mounting unit 132, from a plurality of sealing methods, based on the result of recognition by the recognition unit 26. For example, information on the number or a monetary amount of banknotes that are stored in the banknote storage bag 134 mounted to the mounting unit 132 may be printed near the opening portion of the banknote storage bag 134 by the printing member 138*b*. The setting unit 140 may select and set a sealing method, for sealing the opening portion of the banknote storage bag 134, corresponding to a denomination of banknotes that are stored in the banknote storage bag 134 mounted to the mounting unit 132, from a plurality of sealing methods, based on the result of recognition by the recognition unit 26. In this case, when a plurality of denominations of banknotes are stored in the banknote storage bag 134 mounted to the mounting unit 132, the setting unit 140 may set a sealing method for sealing the opening portion of the banknote storage bag 134 based on the result of recognition by the recognition unit 26 such that the sealing method is different from a sealing method in a case where one denomination of banknotes are stored in the banknote storage bag 134 mounted to the mounting unit 132.

In the present embodiment, the setting unit 140 may not select and set a sealing method for sealing the opening portion of the banknote storage bag 134 from a plurality of sealing methods, based on the result of recognition by the recognition unit 26. In another aspect, the setting unit 140 may select and set a sealing method for sealing the opening portion of the banknote storage bag 134, from a plurality of sealing methods, based on information inputted by the operation/display unit 52, and the control unit 150 may control the sealing unit 138 so as to seal the opening portion of the banknote storage bag 134 mounted to the mounting unit 132, based on the sealing method having been set by the setting unit 140. For example, in a case where an operator inputs, through the operation/display unit 52, information on any of a date and time when banknotes are handled by the banknote handling machine 110, a date and time when the opening portion of the banknote storage bag 134 is sealed by the sealing unit 138, a person in charge of handling of banknotes in the banknote handling machine 110, a place (for example, information on a store in which the banknote handling machine 110 is installed) where the banknote handling machine 110 is installed, and information on the following handling step performed next to the banknote handling machine 110, the printing member 138*b* of the sealing unit 138 may print the information inputted by the operation/display unit 52, near the opening portion of the banknote storage bag 134. The information on the following handling step performed next to the banknote handling machine 110 is information on the following handling step in handling of the banknote storage bag 134. Specifically, in a case where the banknote storage bag 134 taken out from the banknote handling machine 110 is carried to a place for banknote processing, and the banknotes stored in the banknote storage bag 134 are processed by a processing machine installed in the place for banknote processing, the printing member 138*b* of the sealing unit 138 prints characters representing "process by processing machine", near the opening portion of the banknote storage bag 134. In a case where the banknote storage bag 134 taken out from the banknote handling machine 110 is carried to a banknote handling center, the printing member 138*b* of the sealing unit 138 may print a name of the banknote handling center near the opening portion of the banknote storage bag 134. A name of a cash-in-transit company that transfers the banknote storage bag 134 taken out from the banknote handling machine 110 may be printed near the opening portion of the banknote storage bag 134 by the printing member 138*b* of the sealing unit 138.

In the banknote handling machine 110 of the present embodiment, not only when, for example, a guard of a cash-in-transit company or a clerk of a store detaches the banknote storage bag 134 in a full state or nearly full state, from the mounting unit 132 of the lower assembly 16, but also when a predetermined condition is satisfied, the opening portion of the banknote storage bag 134 mounted to the mounting unit 132 may be sealed by the sealing unit 138. Specifically, in a case where the power switch 142 is set to be off by an operator, when the number of banknotes that are stored in the banknote storage bag 134 mounted to the mounting unit 132 is greater than a predetermined number having been preset, the opening portion of the banknote storage bag 134 mounted to the mounting unit 132 is sealed by the sealing unit 138. In a case where difference between: a monetary amount of banknotes, to be stored in the banknote storage bag 134, which is calculated based on a monetary amount of deposited banknotes which is inputted by the operation/display unit 52; and a monetary amount of banknotes, based on the result of recognition by the recognition unit 26, which have been actually stored in the banknote storage bag 134, becomes greater than or equal to a predetermined monetary amount, error in calculation is determined to have occurred, and the opening portion of the banknote storage bag 134 mounted to the mounting unit 132 may be sealed by the sealing unit 138. Alternatively, when the number of times such an error in calculation has occurred is greater than a predetermined number of times, the opening portion of the banknote storage bag 134 mounted to the mounting unit 132 may be sealed by the sealing unit 138. In a case where trouble in storage occurs such that banknotes stored in the banknote storage bag 134 are in a standing state, and the banknotes stored in the banknote storage bag 134 have reached a portion to be sealed by the sealing member 138*a* of the sealing unit 138, in a case where the predicted number of banknotes which are to be deposited in the banknote handling machine 110 on the following day becomes greater than an available capacity of the banknote storage bag 134 mounted to the mounting unit 132 (that is, in a case where overflow is predicted if the banknote storage bag 134 is used as it is on the following day), in a case where the cash-in-transit company that is entrusted with carrying of the banknote storage bag 134 is scheduled to be earlier than the following business day, or in a case where the housing 12 having the banknote storage bag 134 stored therein needs to be unlocked according to information inputted through the operation/display unit 52 or information transmitted from an external device through the communication interface unit 58 to the control unit 150, the opening portion of the banknote storage bag 134 mounted to the mounting unit 132 may be sealed by the sealing unit 138. Thus, also in a case other than a case where, for example, a guard of a cash-in-transit company or a clerk of a store detaches the banknote storage bag 134 in a full state or nearly full state, from the mounting unit 132 of the lower assembly 16, when a predetermined condition is satisfied, the opening portion of the banknote storage bag 134 mounted to the mounting unit 132 is sealed by the sealing unit 138, whereby an operation of collecting the banknote storage bag 134 can be smoothly and flexibly performed.

In the banknote handling machine 110 of the present embodiment, a tape-type storage/feeding unit 30 may be used as a storage for storing banknotes to be managed by the store. Specifically, specific banknotes including, for example, a specific denomination of banknotes such as large denomination notes, banknotes issued by a specific foreign country or organization, sheets such as coupons and checks other than banknotes, and counterfeit notes may be stored in the storage/feeding unit 30. Furthermore, for example, banknotes which are to be handled as proceeds from sales for the following day, banknotes which cannot be determined to be collected, or banknotes to be used as change for the following day, may be stored as specific banknotes in the storage/feeding unit 30. The specific banknotes stored in the storage/feeding unit 30 may be fed out from the storage/feeding unit 30 to the transport unit 24 and transported by the transport unit 24 to the banknote storage bag 134 mounted to the mounting unit 132 when a predetermined condition is satisfied. Specifically, for example, in a case where "banknotes to be handled as proceeds from sales for the following day" are stored as specific banknotes in the storage/feeding unit 30, "the banknotes to be handled as proceeds from sales for the following day" may be fed out from the storage/feeding unit 30 to the transport unit 24, and transported by the transport unit 24 to the banknote storage bag 134 mounted to the mounting unit 132 on the day when the banknotes are handled as proceeds from sales.

In the banknote handling machine 110 and the banknote handling method, according to the present embodiment, having the above-described configuration, banknotes to be stored in the banknote storage bag 134 mounted to the mounting unit 132 are recognized by the recognition unit 26, and the setting unit 140 selects and sets a sealing method for sealing the opening portion of the banknote storage bag 134 from a plurality of sealing methods, based on the result of recognition by the recognition unit 26. The control unit 150 controls the sealing unit 138 so as to seal the opening portion of the banknote storage bag 134 mounted to the mounting unit 132 based on the sealing method having been set by the setting unit 140. Thus, a sealing method for sealing the opening portion of the banknote storage bag 134 is selected from a plurality of sealing methods and set based on the result of recognition of banknotes to be stored in the banknote storage bag 134, whereby an operator can easily know information on banknotes stored in the banknote storage bag 134 by simply looking at the outer appearance of the banknote storage bag 134.

In the banknote handling machine 110 of the present embodiment, as described above, the sealing unit 138 has the sealing member 138*a* for sealing the opening portion of the banknote storage bag 134 mounted to the mounting unit 132, and the setting unit 140 sets a portion, of the banknote storage bag 134 mounted to the mounting unit 132, to be sealed by the sealing member 138*a*, in the sealing method for sealing the opening portion of the banknote storage bag 134, based on the result of recognition by the recognition unit 26. The control unit 150 controls the sealing member 138*a* of the sealing unit 138 so as to seal the portion, of the banknote storage bag 134 mounted to the mounting unit 132, which has been set by the setting unit 140 (see FIG. 10 and FIG. 11).

The sealing member 138*a* seals, by heat, the opening portion of the banknote storage bag 134 mounted to the mounting unit 132. The banknote storage bag 134 to be mounted to the mounting unit 132 has a plurality of heat-sensitive light emission layers 134*a* to 134*c* having different colors, respectively. When a portion, of the banknote storage bag 134 mounted to the mounting unit 132, to be sealed by the sealing member 138*a* is set, the setting unit 140 may select and set a heat-sensitive light emission layer to be sealed by the sealing member 138*a*, from the plurality of heat-sensitive light emission layers 134*a* to 134*c* disposed in the banknote storage bag 134, based on the result of recognition by the recognition unit 26, and the control unit 150 may control the sealing member 138*a* of the sealing unit 138 so as to seal the heat-sensitive light emission layer having been set by the setting unit 140 (see FIG. 12). The sealing member 138*a* may not seal, by heat, the opening portion of the banknote storage bag 134 mounted to the mounting unit 132. As the sealing member 138*a*, a sealing member which seals the opening portion of the banknote storage bag 134 mounted to the mounting unit 132 by a method other than the method using heat, may be used.

In the banknote handling machine 110 of the present embodiment, as described above, the sealing unit 138 may have the sealing member 138*a* that seals the opening portion of the banknote storage bag 134 mounted to the mounting unit 132, and the printing member 138*b* that performs printing on the banknote storage bag 134 mounted to the mounting unit 132, and the setting unit 140 may set a content to be printed on the banknote storage bag 134 by the printing member 138*b*, in the sealing method for sealing the opening portion of the banknote storage bag 134, based on the result of recognition by the recognition unit 26. In this case, the control unit 150 controls the printing member 138*b* of the sealing unit 138 so as to perform printing on the banknote storage bag 134 mounted to the mounting unit 132, based on the content, to be printed, which has been set by the setting unit 140 (see FIG. 13). At this time, the printing member 138*b* may perform printing at a portion, of the banknote storage bag 134 mounted to the mounting unit 132, which has been sealed by the sealing member 138*a*.

In the banknote handling machine 110 of the present embodiment, as described above, the sealing unit 138 may have the sealing member 138*a* that seals the opening portion of the banknote storage bag 134 mounted to the mounting unit 132, and the marking member 138*c* that marks the banknote storage bag 134 mounted to the mounting unit 132, and the setting unit 140 may set a content with which the banknote storage bag 134 is marked by the marking member 138*c*, in the sealing method for sealing the opening portion of the banknote storage bag 134, based on the result of recognition by the recognition unit 26. In this case, the control unit 150 controls the marking member 138*c* of the sealing unit 138 so as to mark the banknote storage bag 134 mounted to the mounting unit 132, based on the content, to be marked, which has been set by the setting unit 140 (see FIG. 14). At this time, the marking member 138*c* may perform marking at a portion, of the banknote storage bag 134 mounted to the mounting unit 132, which has been sealed by the sealing member 138*a*.

In the banknote handling machine 110 of the present embodiment, as described above, the sealing unit 138 may have the sealing member 138*a* that seals the opening portion of the banknote storage bag 134 mounted to the mounting unit 132, and the cutting member 138*d* that partially cuts the banknote storage bag 134 mounted to the mounting unit 132, and the setting unit 140 may set a portion, of the banknote storage bag 134 mounted to the mounting unit 132, to be cut by the cutting member 138*d*, in the sealing method for sealing the opening portion of the banknote storage bag 134, based on the result of recognition by the recognition unit 26. In this case, the control unit 150 controls the cutting member 138*d* of the sealing unit 138 so as to cut the banknote storage bag 134 mounted to the mounting unit 132 at the portion having been set by the setting unit 140 (see FIG. 15 and FIG. 16). In the aspect shown in FIG. 15 and FIG. 16, the cutting member 138*d* of the sealing unit 138 forms a hole near the opening portion of the banknote storage bag 134 mounted to the mounting unit 132. However, the cutting member 138*d* is not limited to such an aspect. As the cutting member 138*d* of the sealing unit 138, a cutting member that forms a cut portion at the edge of the banknote storage bag 134 mounted to the mounting unit 132, may be used. In this case, the setting unit 140 selects and sets a portion, of the banknote storage bag 134 mounted to the mounting unit 132, at which the cut portion is formed by the cutting member 138*d*, from a plurality of portions, in the sealing method for sealing the opening portion of the banknote storage bag 134, based on the result of recognition by the recognition unit 26.

In the banknote handling machine 110 and the banknote handling method according to the present embodiment, information on handling of banknotes is inputted by the operation/display unit 52 as an input unit, and the setting unit 140 selects and sets a sealing method for sealing the opening portion of the banknote storage bag 134, from a plurality of sealing methods, based on the information inputted by the operation/display unit 52 as an input unit. The control unit 150 controls the sealing unit 138 so as to seal the opening portion of the banknote storage bag 134 mounted to the mounting unit 132, based on the sealing method having been set by the setting unit 140. Thus, the sealing method for sealing the opening portion of the banknote storage bag 134 is selected from a plurality of sealing methods and set, based on information, on handling of banknotes, which is inputted by the operation/display unit 52, whereby an operator can easily know information on handling of banknotes stored in the banknote storage bag 134 by simply looking at the outer appearance of the banknote storage bag 134.

The banknote handling machine 110 and the banknote handling method according to the present embodiment are not limited to the above-described aspects, and various modifications can be added.

For example, in the banknote handling machine 110 of the present embodiment, a banknote storage bag in which the internal region is sectioned into a plurality of regions by a sectioning member may be used as the banknote storage bag mounted to the mounting unit 132. The configuration of such a banknote storage bag will be described with reference to FIG. 17 and FIG. 18.

Figure 17:
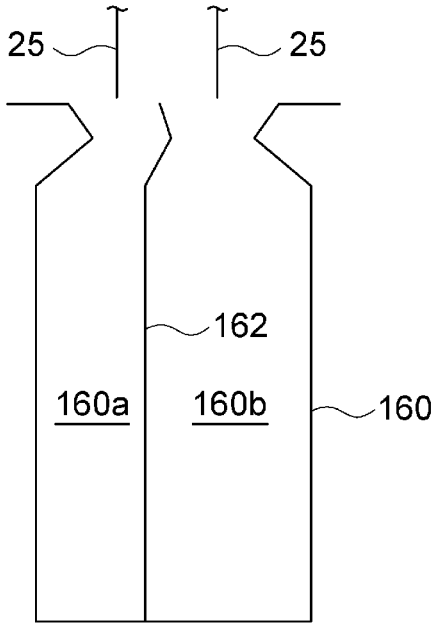
FIG. 17 is a side view showing another example of a structure of a banknote storage bag mounted to a mounting unit in the banknote handling machine shown in FIG. 8.

A banknote storage bag 160 shown in FIG. 17 has an internal region that is sectioned into two regions 160*a*, 160*b* by a sectioning member 162, and has a plurality of openings corresponding to the regions 160*a*, 160*b*, respectively. In this case, the internal region of the banknote storage bag 160 is sectioned by the sectioning member 162 that extends along the longitudinal direction of the banknote storage bag 160 so as to align the two regions 160*a*, 160*b* in the left-right direction. A plurality (two in the example shown in FIG. 17) of diverged transport units 25 corresponding to the openings, respectively, of the banknote storage bag 160 are disposed for one mounting unit 132. Banknotes are sent from the diverged transport units 25 to the regions 160*a*, 160*b*, respectively, of the banknote storage bag 160 mounted to the mounting unit 132, and stored in the regions 160*a*, 160*b*. The same denomination of banknotes are stored in one banknote storage bag 160. However, for example, banknotes determined as genuine banknotes based on the result of recognition by the recognition unit 26 are stored in the first region 160*a*, and banknotes determined as being not genuine banknotes based on the result of recognition by the recognition unit 26 are stored in the second region 160*b*. Furthermore, when the banknote storage bag 160 is mounted to the mounting unit 132, banknotes may be stored in the first region 160*a*, and mediums (for example, receipt or the like) other than banknotes may be stored in the second region 160*b*. Alternatively, in a case where the banknote handling machine 110 of the present embodiment is provided with a coin handling machine, banknotes may be stored in one region 160*a*, and coins transported from the coin handling machine may be stored in the other region 160*b*.

In the example shown in FIG. 17, the internal region of the banknote storage bag 160 is sectioned into the two regions 160*a*, 160*b* by the sectioning member 162. However, in another modification, the internal region of a banknote storage bag may be sectioned into three or more regions by a plurality of sectioning members. In this case, fit notes determined as genuine banknotes based on the result of recognition by the recognition unit 26 may be stored in the first region, unfit notes determined as genuine banknotes based on the result of recognition by the recognition unit 26 may be stored in the second region, and banknotes determined as being not genuine banknotes based on the result of recognition by the recognition unit 26 may be stored in the third region. Alternatively, banknotes determined as having been domestically issued based on the result of recognition by the recognition unit 26 may be stored in the first region, banknotes determined as having been issued by a foreign country or organization based on the result of recognition by the recognition unit 26 may be stored in the second region, and banknotes determined as being not genuine banknotes based on the result of recognition by the recognition unit 26 may be stored in the third region. Alternatively, a financial facility to which a banknote storage bag is to be carried is allocated to each region, and banknotes may be stored in the region for each financial facility to which the banknotes are to be carried.

Figure 18:
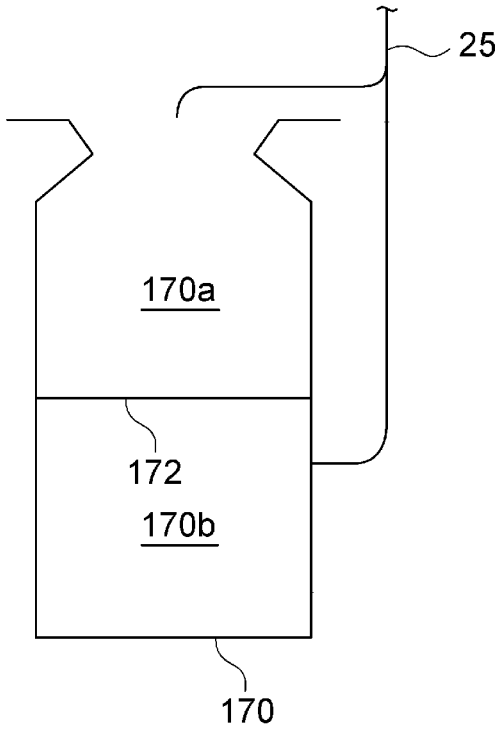
FIG. 18 is a side view showing still another example of a structure of a banknote storage bag mounted to a mounting unit in the banknote handling machine shown in FIG. 8.

A banknote storage bag having the configuration as shown in FIG. 18 may be used as a banknote storage bag having the internal region sectioned into a plurality of regions by a sectioning member. A banknote storage bag 170 shown in FIG. 18 has the internal region that is sectioned into two regions 170*a*, 170*b* by a sectioning member 172. A plurality of openings of the banknote storage bag 170 corresponding to the regions 170*a*, 170*b*, respectively, are disposed. In this case, the internal region of the banknote storage bag 170 is sectioned by the sectioning member 172 that extends along the width direction of the banknote storage bag 170 so as to align the two regions 170*a*, 170*b* in the up-down direction. The diverged transport units 25 corresponding to openings, respectively, of the banknote storage bag 170 diverge, and banknotes are sent to the regions 170*a*, 170*b* of the banknote storage bag 170 mounted to the mounting unit 132 from the respective ends of diverged portions of the diverged transport unit 25, and are stored in the regions 170*a*, 170*b*. The same denomination of banknotes are stored in one banknote storage bag 170. However, for example, banknotes determined as genuine banknotes based on the result of recognition by the recognition unit 26 are stored in the first region 170*a*, and banknotes determined as being not genuine banknotes based on the result of recognition by the recognition unit 26 are stored in the second region 170*b*.

In a case where the banknote storage bags 160, 170 as shown in FIG. 17 and FIG. 18 are used, a plurality of kinds of valuable mediums (specifically, banknotes, coins, and the like) can be stored and collected in one banknote storage bag.

The money handling machine according to the present invention is not limited to the banknote handling machine 110 that performs handling of banknotes. As the money handling machine according to the present invention, a coin handling machine to which the principle of the present invention is applied may perform handling of coins. Specifically, when a coin handling machine that performs handling of coins includes: a mounting unit to which a coin storage bag in which coins are stored is mounted; and a sealing unit for sealing an opening portion of the coin storage bag mounted to the mounting unit, a recognition unit recognizes coins to be stored in the coin storage bag mounted to the mounting unit, and a setting unit selects and set a sealing method for sealing an opening portion of the coin storage bag, from a plurality of sealing methods, based on the result of recognition by the recognition unit. A control unit controls the sealing unit so as to seal the opening portion of the coin storage bag mounted to the mounting unit based on the sealing method having been set by the setting unit. Thus, the sealing method for sealing the opening portion of the coin storage bag is selected from a plurality of sealing methods and set, based on the result of recognition of coins to be stored in the coin storage bag, whereby an operator can easily know information on coins stored in the coin storage bag by simply looking at the outer appearance of the coin storage bag. When a coin handling machine is used as the money handling machine according to the present invention, information on handling of coins may be inputted by an input unit, and the setting unit may select and set a sealing method for sealing the opening portion of the coin storage bag, from a plurality of sealing methods, based on the information having been inputted through the input unit. Also in this case, the control unit controls the sealing unit so as to seal the opening portion of the coin storage bag mounted to the mounting unit, based on the sealing method having been set by the setting unit. In such an aspect, a sealing method for sealing the opening portion of the coin storage bag is selected from a plurality of sealing methods, and set based on information, on handling of coins, having been inputted through the input unit, whereby an operator can easily know information on handling of coins stored in the coin storage bag by simply looking at the outer appearance of the coin storage bag.

Third Embodiment

Figure 19:
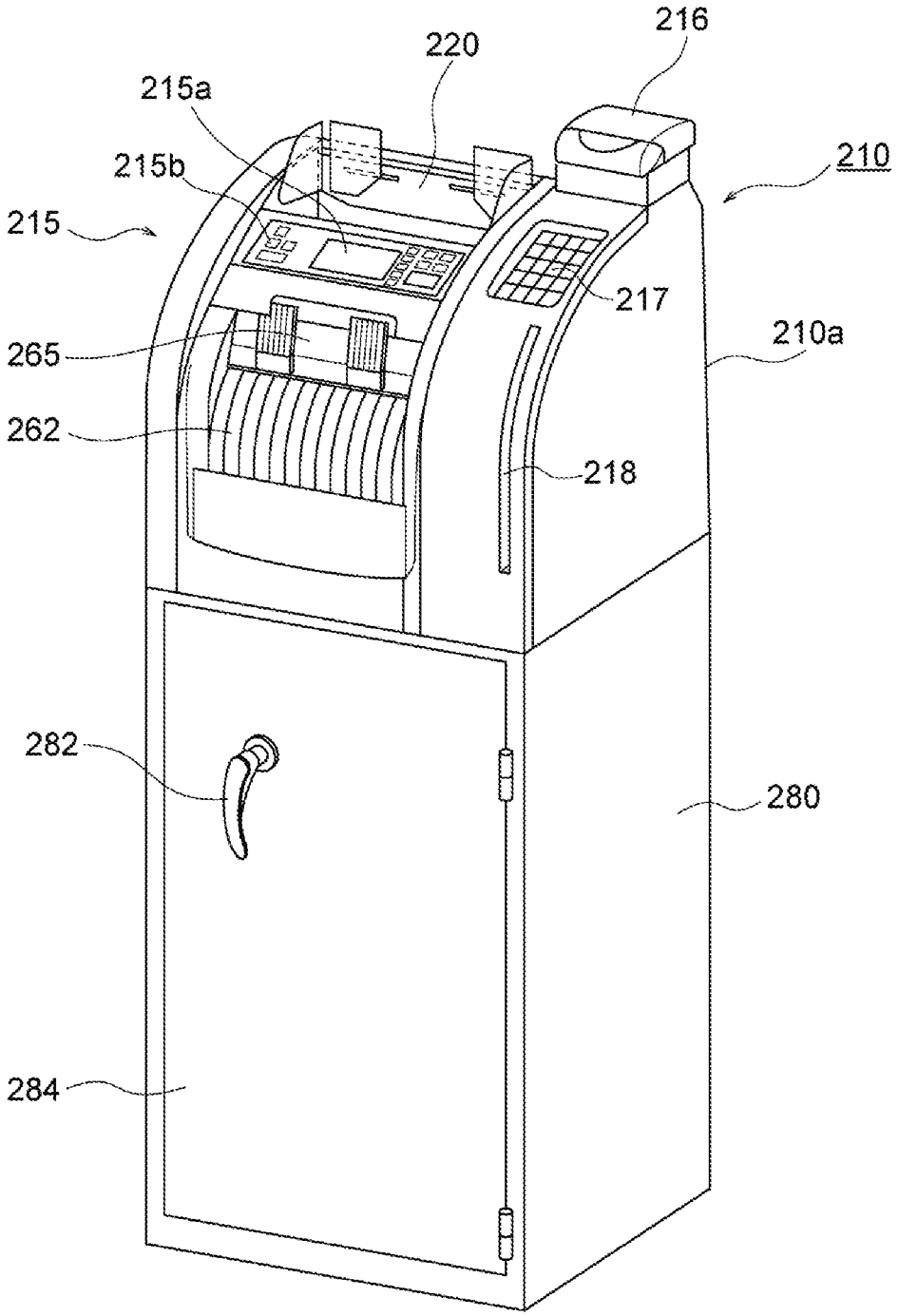
FIG. 19 is a perspective view illustrating an outer appearance of a banknote depositing machine according to a third embodiment of the present invention.
Figure 20:
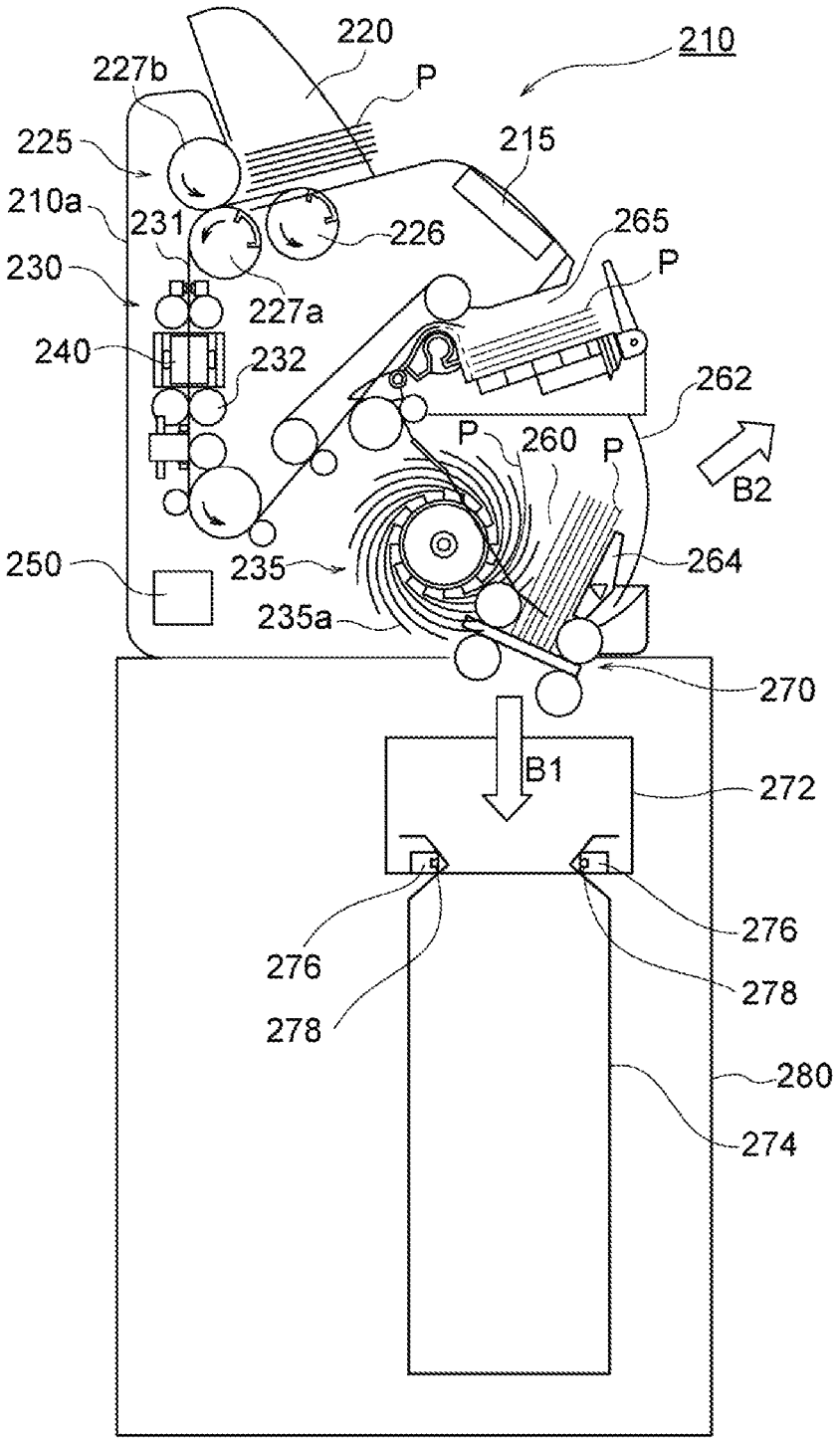
FIG. 20 is a side view showing an internal structure of the banknote depositing machine shown in FIG. 19.
Figure 21:
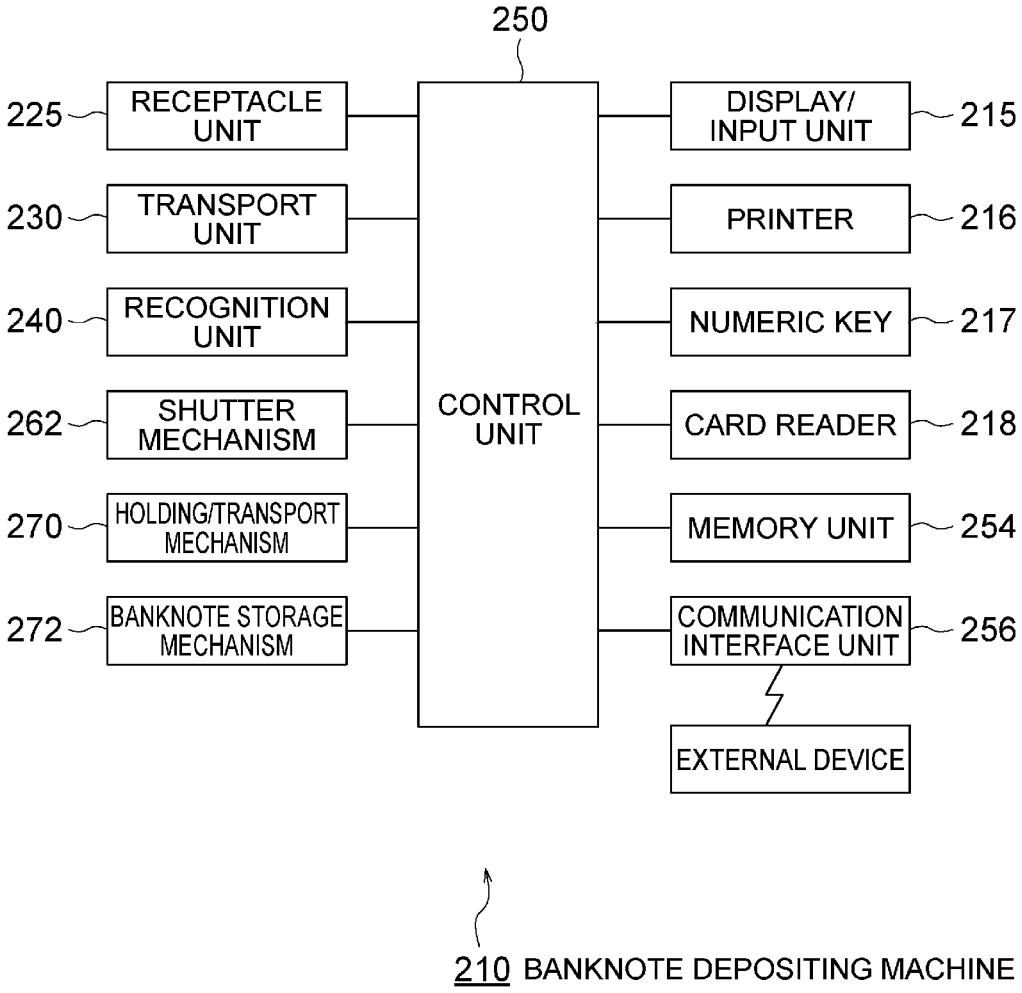

A third embodiment of the present invention will be described below with reference to the drawings. FIG. 19 to FIG. 21 illustrate a banknote depositing machine according to the third embodiment.

As shown in FIG. 19 and FIG. 20, a banknote depositing machine 210 of the present embodiment includes: a housing 210*a*; a placement unit 220 which is disposed at the upper portion of the housing 210*a* and on which a plurality of banknotes P are placed; a receptacle unit 225 for taking in the plurality of banknotes P placed on the placement unit 220 one by one into the housing 210*a*; a transport unit 230 for transporting the banknotes P having been taken in by the receptacle unit 225; a stacking unit 260 for stacking the banknotes P transported by the transport unit 230; and a recognition unit 240 which is disposed at the transport unit 230, and recognizes denominations, authenticity, and the like of the banknotes P transported by the transport unit 230 and counts the banknotes.

Among them, the receptacle unit 225 includes, as shown in FIG. 20, a kicker roller 226 for kicking, one by one, the banknote P disposed at the lowermost position among the plurality of banknotes P placed on the placement unit 220, and a feed roller 227*a* which is disposed downstream of the kicker roller 226 in the direction of feeding of the banknotes P, and which feeds out the banknotes P kicked by the kicker roller 226, one by one, into the housing 210*a*. A gate roller 227*b* (reverse rotation roller) is disposed so as to face the feed roller 227*a*, and a gate unit is formed between the feed roller 227*a* and the gate roller 227*b*.

As shown in FIG. 20, the transport unit 230 includes a transport belt 231, transport rollers 232, and the like for transporting the banknotes P. A stacking wheel 235 that receives the banknotes P transported by the transport unit 230, for each banknote P, between vanes 235*a* to align and stack the banknotes P in the stacking unit 260 is disposed near the stacking unit 260 at the most downstream portion of the transport unit 230.

As shown in FIG. 20, a reject unit 265 is disposed at the transport unit 230, and the banknotes P which are not transported to the stacking unit 260 when abnormality occurs, are transported to the reject unit 265. In the description herein, the abnormality refers to abnormality in recognition and abnormality in transporting. Abnormality in recognition represents a case where information recognized by the recognition unit 240 does not coincide with information which is previously stored in a control unit 250 described below. Examples of such abnormality in recognition include a state in which a banknote P is recognized as a banknote P having a kind different from an expected kind (for example, denomination, fitness, and the like), and a state where a kind of the banknotes P cannot be recognized. Abnormality in transporting refers to abnormality that occurs when the banknotes P are transported by the transport unit 230. Examples of such abnormality in transporting include a state (skew) in which the banknote P is diagonally transported, a state (chaining) in which a plurality of banknotes P are transported so as not to be spaced from each other at predetermined intervals, and a state (overlapping) in which a plurality of banknotes P are transported so as to overlap each other.

As shown in FIG. 20, in the stacking unit 260, the stacked banknotes P are tilted toward the front surface side, and the banknotes P transported from the transport unit 230 are supported by a support unit 264 and thus stacked in a standing state so as to be tilted toward the front surface side. In the banknote depositing machine 210 shown in FIG. 19 and FIG. 20, the front surface side refers to a side on which an operator places the banknotes P on the placement unit 220, and takes out the banknotes P from the stacking unit 260, and refers to the right side in FIG. 20. Meanwhile, in the banknote depositing machine 210 shown in FIG. 19 and FIG. 20, the rear surface side refers to the side opposite to the front surface side, and refers to the left side in FIG. 20.

As shown in FIG. 19 and FIG. 20, a shutter mechanism 262 for opening and closing an opening portion, in the front surface, through which the stacked banknotes P are taken out is disposed on the front surface side of the stacking unit 260. The shutter mechanism 262 is controlled, by the control unit 250 described below, so as not to be openable at least when a holding/transport mechanism 270 (described below) transports the banknotes P to a banknote storage mechanism 272 (described below).

A storage housing 280 is disposed at the lower portion of the banknote depositing machine 210 shown in FIG. 19 and FIG. 20, and the banknote storage mechanism 272 for storing banknotes in a banknote storage bag 274 such as a pouch having an opening portion on one side is disposed in the storage housing 280. The banknote storage mechanism 272 of the banknote depositing machine 210 shown in FIG. 19 and FIG. 20 has almost the same structure as the banknote storage mechanism 32 shown in FIG. 3 to FIG. 5. Specifically, the banknote storage mechanism 272 has a pair of holding members 276 that are spaced so as to face each other. Two portions, of the banknote storage bag 274, which are near the opening portion of the banknote storage bag 274 and which face each other are held by the holding members 276, respectively. The first holding member 276 (specifically, for example, the holding member 276 on the right side in FIG. 20) is fixedly positioned, whereas the second holding member 276 (specifically, for example, the holding member 276 on the left side in FIG. 20) can be moved toward the first holding member 276 that is fixedly positioned. As shown in FIG. 20, the holding members 276 have heating members 278, respectively. After a predetermined number of banknotes are stored in the banknote storage bag 274 held by each holding member 276 in the banknote storage mechanism 272, before the banknote storage bag 274 is taken out from the banknote storage mechanism 272, the second holding member 276 is moved toward the first holding member 276, and the holding members 276 touch each other. In this state, the heating member 278 heats a portion, near the opening portion, of the banknote storage bag 274, whereby the opening portion of the banknote storage bag 274 is heat-sealed (thermally sealed). In the banknote storage mechanism 272, instead of the second holding member 276 being moved toward the first holding member 276, both the holding members 276 may be moved toward each other up to the center position, and the holding members 276 may touch each other at the center position.

As shown in FIG. 20, the stacking unit 260 is provided with the holding/transport mechanism 270 that holds the surface of the banknotes P stacked in the stacking unit 260, and transport the banknotes P in the direction parallel to the surface, thereby storing the banknotes P in the banknote storage bag 274 held by each holding member 276 of the banknote storage mechanism 272. More specifically, the holding/transport mechanism 270 can hold the surface of the banknote P disposed on the forefront surface side and the surface of the banknote P disposed on the rearmost surface side, among the plurality of banknotes P stacked in the stacking unit 260, and collectively transport the plurality of banknotes P to the banknote storage mechanism 272 (see an arrow $B_1$ in FIG. 20).

As shown in FIG. 19, a door 284 is disposed on the front surface of the storage housing 280. When the door 284 is opened, each holding member 276 of the banknote storage mechanism 272 can be caused to hold the banknote storage bag 274 or the banknote storage bag 274 held by each holding member 276 can be taken out from the storage housing 280 to the outside. More specifically, the door 284 is provided with a handle 282 and an electromagnetic key (not shown). The electromagnetic key is controlled so as to be unlocked, and the handle 282 is turned, to open the door 284. The banknote storage bag 274 is collected from the storage housing 280 by a guard of a cash-in-transit company, or the like. The banknote storage bag 274 collected from the storage housing 280 by the guard of the cash-in-transit company, or the like is transferred to a cash center of the cash-in-transit company.

Next, flow of banknotes which are inserted in the banknote depositing machine 210 and flow of a valuable medium which is inserted from the outside will be briefly described. In a case where banknotes are inserted in the banknote depositing machine 210, when a plurality of banknotes are placed on the placement unit 220, banknotes are taken in into the housing 210*a*, one by one, by the receptacle unit 225, and recognized by the recognition unit 240, and thereafter transported to the stacking unit 260 or the reject unit 265. Thereafter, banknotes stacked in the stacking unit 260 are stored in the banknote storage bag 274 held by each holding member 276 of the banknote storage mechanism 272. In a case where a valuable medium is inserted in the banknote depositing machine 210, the shutter mechanism 262 of the stacking unit 260 is opened, and, when an envelope that contains the valuable medium is set in the stacking unit 260, the envelope that contains the valuable medium is stored in the banknote storage bag 274 held by each holding member 276 of the banknote storage mechanism 272.

Thus, in the banknote depositing machine 210 shown in FIG. 19 and FIG. 20, the banknotes P and the valuable mediums are stored so as to be mixed in the banknote storage bag 274 held by each holding member 276 of the banknote storage mechanism 272. The banknotes P and the valuable mediums stored in the banknote storage bag 274 are managed not under the authority of a store but under authority of a cash-in-transit company.

As shown in FIG. 19, a display/input unit 215 which has a function of displaying predetermined information and a function of allowing data input is disposed in the housing 210*a* of the banknote depositing machine 210. The display/input unit 215 includes a monitor 215*a* for displaying, for example, a result of counting the banknotes P, and a plurality of input keys 215*b* that allow an operator to input various instructions. On the monitor 215*a*, for example, the number of the banknotes P, for each denomination, stored in the banknote storage bag 274 is displayed. The plurality of input keys 215*b* include a menu key, an exchange key, a clearing key, an acceptance key, an arrow key representing upward, downward, leftward, and rightward directions, a shift key, a mode key, a closing key, a collection key, a start/stop key, and the like.

As shown in FIG. 19, in the housing 210*a* of the banknote depositing machine 210, a printer 216 for printing, for example, a result of counting the banknotes P, a numeric key 217 that allows an operator to perform various inputs into the control unit 250 described below, and a card reader 218 for reading an ID card of an operator in order to obtain identification information of the operator, are disposed.

The banknote depositing machine 210 shown in FIG. 19 and FIG. 20 includes the control unit 250 as shown in FIG. 21. The control unit 250 controls the components of the banknote depositing machine 210. As shown in FIG. 21, the receptacle unit 225, the transport unit 230, the recognition unit 240, the shutter mechanism 262, the holding/transport mechanism 270, the banknote storage mechanism 272, the display/input unit 215, the printer 216, the numeric key 217, the card reader 218, and the like are connected to the control unit 250. Recognition/count information, of the banknotes P, obtained through recognition/counting by the recognition unit 240 is transmitted to the control unit 250. Various instructions inputted by an operator through each input key 215*b* of the display/input unit 215 or the numeric key 217 are transmitted to the control unit 250. Furthermore, for example, identification information, of an operator, read by the card reader 218 is also transmitted to the control unit 250. The control unit 250 transmits an instruction signal to each component such as the receptacle unit 225, the transport unit 230, the shutter mechanism 262, the holding/transport mechanism 270, the banknote storage mechanism 272, the display/input unit 215, and the printer 216, and controls the components.

As shown in FIG. 21, a memory unit 254 is connected to the control unit 250. In the memory unit 254, for example, information, to be preset, such as device identification information for identifying the banknote depositing machine 210, identification information of an operator who is allowed to use the device, and a result of counting the banknotes P are stored.

As shown in FIG. 21, a communication interface unit 256 is connected to the control unit 250. The control unit 250 can transmit a signal to and receive a signal from an external device via the communication interface unit 256.

Next, an operation performed by the banknote depositing machine 210 having such a configuration will be described.

Firstly, an operator inputs an instruction for performing depositing of the banknotes P, into the control unit 250, by using the display/input unit 215. More specifically, the operator selects a command for "counting/depositing" by using the display/input unit 215. At this time, the identification information of the operator is also inputted into the control unit 250 by using each input key 215*b* of the display/input unit 215, and/or the numeric key 217, or the card reader 218. When the control unit 250 receives such a signal, the control unit 250 controls the shutter mechanism 262 such that the shutter mechanism 262 cannot be opened. Subsequently, when the operator places a plurality of banknotes P on the placement unit 220, the plurality of banknotes P placed on the placement unit 220 are taken in into the machine one by one by the receptacle unit 225. At this time, among the plurality of banknotes P placed on the placement unit 220, the banknote P disposed on the lowermost position is kicked by the kicker roller 226 and fed out by the feed roller 227*a*, whereby the banknotes P are fed out one by one by action of the gate roller 227*b*.

Subsequently, the banknotes P taken in by the receptacle unit 225 are transported by the transport unit 230. At this time, the recognition unit 240 disposed at the transport unit 230 recognizes and counts the banknotes P transported by the transport unit 230. Thus, in a case where abnormality in recognition or abnormality in transporting occurs when the banknotes P are transported by the transport unit 230, the banknotes P are transported to the reject unit 265. Meanwhile, when such abnormality in recognition or abnormality in transporting does not occur, the banknotes P being transported are sent to the stacking unit 260. When the banknotes P are transported to the stacking unit 260, each banknote P is received between the vanes 235*a* of the stacking wheel 235, and the banknotes P are aligned and stacked in the stacking unit 260. The banknotes P sent by the stacking wheel 235 are stacked in the stacking unit 260 in a standing state so as to be tilted toward the front surface side. On the display/input unit 215, the total monetary amount of the banknotes P stacked in the stacking unit 260 is displayed. The recognition result (the number and the total monetary amount of banknotes for each denomination) is stored in the memory unit 254 so as to be associated with identification information of the operator.

As described above, when all the plurality of banknotes P placed on the placement unit 220 are transported to the stacking unit 260, and the banknotes P are no longer in the placement unit 220, display for requesting an instruction for accepting the total monetary amount of the banknotes P stacked in the stacking unit 260 is displayed on the display/input unit 215. When the operator inputs acceptance instruction through the display/input unit 215 (specifically, when the operator presses the acceptance key on the display/input unit 215), the plurality of banknotes P stacked in the stacking unit 260 are stored, by the holding/transport mechanism 270, in the banknote storage bag 274 held by each holding member 276 of the banknote storage mechanism 272 (see the arrow $B_1$ in FIG. 20). When the banknotes P have been stored in the banknote storage bag 274, the banknotes P in the banknote storage bag 274 are managed not under authority of the store but under authority of the cash-in-transit company. When the banknotes P are in the reject unit 265, the operator places again the banknotes P in the placement unit 220, the same handling steps as described above are repeated, and all the banknotes P are transported to the stacking unit 260. However, the banknote P, which has been transported to the reject unit 265 although the banknote P has been handled several times, is determined as the banknote P which cannot be received, and eliminated from banknotes to be stored. When the operator cannot accept the total monetary amount, the operator inputs a return instruction through the display/input unit 215. In this case, the shutter mechanism 262 is opened, the stacked banknotes P can be taken out from the stacking unit 260 (see an arrow $B_2$ in FIG. 20), the operator takes out the banknotes P stacked in the stacking unit 260, from the front surface of the housing 210*a*, and the handling is ended.

Next, an operation performed by the banknote depositing machine 210 when banknotes are collected will be described. When, for example, a guard of a cash-in-transit company collects the banknote storage bag 274 storing banknotes, from the banknote depositing machine 210, the electromagnetic key is firstly controlled so as to be unlocked by the guard, and the handle 282 is subsequently turned, to open the door 284. When the electromagnetic key has been unlocked by the guard, the opening portion of the banknote storage bag 274 held by each holding member 276 in the banknote storage mechanism 272 is heat-sealed (thermally sealed) by each heating member 278. The guard opens the door 284, and thereafter detaches the banknote storage bag 274 from each holding member 276, thereby taking out and collecting the banknote storage bag 274 to the outside of the storage housing 280. As described above, the banknote storage bag 274 collected from the storage housing 280 by the guard of the cash-in-transit company, or the like is transferred to a cash center of the cash-in-transit company.

Next, an operation performed when a valuable medium, other than cash, such as an unfit note, deformed coin, a voucher, and a check which cannot be recognized by the recognition unit 240 of the banknote depositing machine 210 is stored directly into the banknote storage bag 274 held by each holding member 276 of the banknote storage mechanism 272, will be described. The operation described below is performed based on a signal transmitted to each component from the control unit 250 unless otherwise specified.

Firstly, an operator inputs an instruction for storing a valuable medium other than the banknotes P in the banknote storage bag 274, into the control unit 250, by using the display/input unit 215. More specifically, the operator selects a command for "depositing of valuable medium (depositing of non-cash medium)" by using the display/input unit 215. At this time, identification information of the operator is also inputted into the control unit 250 by using each input key 215*b* of the display/input unit 215, and/or the numeric key 217, or the card reader 218. The operator inputs information on the valuable medium, specifically, a monetary amount or the like of the valuable medium, into the control unit 250, by using each input key 215*b* of the display/input unit 215, and/or the numeric key 217, and presses the acceptance key. Thus, information, on the valuable medium, inputted into the control unit 250 by the operator is printed as a journal by the printer 216. At this time, the shutter mechanism 262 is opened by the control unit 250, and an envelope which contains the valuable medium can be inserted in the stacking unit 260.

Thereafter, the operator sets, in the stacking unit 260, the envelope that contains the valuable medium and the journal on which information on the valuable medium is printed, and presses the acceptance key, whereby the shutter mechanism 262 is closed. The envelope that contains the valuable medium and the journal that have been set in the stacking unit 260, are stored in the banknote storage bag 274 held by each holding member 276 of the banknote storage mechanism 272 by the holding/transport mechanism 270 (see the arrow $B_1$ in FIG. 20). When the envelope that contains the valuable medium has been stored in the banknote storage bag 274, the valuable medium in the banknote storage bag 274 is managed not under authority of the store but under authority of the cash-in-transit company. Thus, an operation for storing the valuable medium in the banknote storage bag 274 is ended.

In the banknote depositing machine 210 shown in FIG. 19 to FIG. 21, not only valuable mediums associated with the monetary amounts, but also mediums which are not associated with the monetary amount may be stored in the banknote storage bag 274. Specifically, as a medium which is not associated with the monetary amount, for example, a sales slip of a store, a discount coupon and a service ticket issued by the store, a journal on which proceeds from sales for a day other than the current day are printed, or a letter or a communication book being brought back and forth between the store and the cash-in-transit company, and the like may be stored in the banknote storage bag 274. In this case, these mediums are sent together with the banknote storage bag 274 from the store to the cash-in-transit company, or from the cash-in-transit company to the store. The medium which is not associated with the monetary amount can be also stored directly into the banknote storage bag 274 from the front surface of the housing 210*a* by opening the shutter mechanism 262 without transporting the medium through the receptacle unit 225, the transport unit 230, and the recognition unit 240.

In the banknote depositing machine 210 shown in FIG. 19 to FIG. 21, the shutter mechanism 262 functions as an opening and closing unit for opening and closing a path between the outside of the housing 210*a*, and the opening portion of the banknote storage bag 274 held by each holding member 276. The shutter mechanism 262 is used as a regulation unit for selectively regulating access to the banknote storage bag 274 held by each holding member 276. The control unit 250 controls the shutter mechanism 262 as the regulation unit so as to allow access to the banknote storage bag 274 held by each holding member 276 in a state where the opening portion of the banknote storage bag 274 is opened, when a predetermined condition has been satisfied. More specifically, as described above, in a case where a command for "depositing of valuable medium (depositing of non-cash medium)" is selected through the display/input unit 215, and, thus, an instruction for inserting valuable mediums and the like directly into the banknote storage bag 274 held by each holding member 276 without transporting the valuable mediums and the like through the receptacle unit 225, the transport unit 230, and the recognition unit 240, is inputted, the control unit 250 determines that the predetermined condition has been satisfied, and the shutter mechanism 262 is opened so as to allow access to the banknote storage bag 274 held by each holding member 276 in a state where the opening portion of the banknote storage bag 274 is opened. In a case where authority of an operator authenticated by using each input key 215*b* of the display/input unit 215, and/or the numeric key 217, or the card reader 218 is a predetermined authority (for example, manager or store manager of the store), the control unit 250 may determine that the predetermined condition has been satisfied, and the shutter mechanism 262 may be opened so as to allow access to the banknote storage bag 274 held by each holding member 276 in a state where the opening portion of the banknote storage bag 274 is opened. Thus, the control unit 250 controls the shutter mechanism 262 as the regulation unit so as to allow a valuable medium or the like to be stored directly into the banknote storage bag 274 held by each holding member 276 without transporting the valuable medium or the like through the receptacle unit 225, the transport unit 230, and the recognition unit 240, when the predetermined condition has been satisfied.

In the banknote depositing machine 210 shown in FIG. 19 to FIG. 21, information on a valuable medium or the like that is stored directly into the banknote storage bag 274 held by each holding member 276 without transporting the valuable medium or the like through the receptacle unit 225, the transport unit 230, and the recognition unit 240, may be inputted by each input key 215*b* of the display/input unit 215 and/or the numeric key 217. Thus, the control unit 250 can manage information on the valuable medium or the like which is stored directly into the banknote storage bag 274. Information on the valuable medium or the like which is stored directly into the banknote storage bag 274 held by each holding member 276 without transporting the valuable medium or the like through the receptacle unit 225, the transport unit 230, and the recognition unit 240, and information (that is, information on banknotes stored in the banknote storage bag 274 by depositing of the banknotes) on banknotes which are stored into the banknote storage bag 274 held by each holding member 276 through the receptacle unit 225, the transport unit 230, and the recognition unit 240 may be managed, by the control unit 250, so as to be distinguished from each other.

In the banknote storage mechanism 272, in a case where the shutter mechanism 262 is opened to allow access to the banknote storage bag 274 held by each holding member 276 in a state where the opening portion of the banknote storage bag 274 is opened, the opening portion of the banknote storage bag 274 may be sealed by each heating member 278 in a manner different from a manner for a case where access to the banknote storage bag 274 is not allowed. Specifically, in a case where access to the banknote storage bag 274 held by each holding member 276 is allowed in a state where the opening portion of the banknote storage bag 274 is opened, when the opening portion of the banknote storage bag 274 is sealed by each heating member 278, a specific character or mark may be formed near a portion at which the opening portion of the banknote storage bag 274 is sealed, or the opening portion of the banknote storage bag 274 may be sealed at a plurality of portions. In this case, when the banknote storage bag 274 is collected from the storage housing 280 of the banknote depositing machine 210, a guard of a cash-in-transit company, or the like can easily know that a valuable medium or the like may have been additionally stored in the banknote storage bag 274 or a banknote may have been taken out from the banknote storage bag 274. In another example, in a case where the shutter mechanism 262 is opened to allow access to the banknote storage bag 274 held by each holding member 276 in a state where the opening portion of the banknote storage bag 274 is opened, and an operator inputs, through each input key 215*b* of the display/input unit 215, and/or the numeric key 217, information on the valuable medium or the like that is stored directly in the banknote storage bag 274 without transporting the valuable medium or the like through the receptacle unit 225, the transport unit 230, and the recognition unit 240, when the opening portion of the banknote storage bag 274 is sealed by each heating member 278, characters or a mark indicating that the valuable medium or the like has been stored into the banknote storage bag 274 may be formed near a portion at which the opening portion of the banknote storage bag 274 is sealed.

As described above, similarly to the banknote handling machine 10 according to the first embodiment shown in FIG. 1 to FIG. 7, the banknote depositing machine 210 according to the third embodiment shown in FIG. 19 to FIG. 21 also includes: the holding members 276 as a holding unit for holding a storage bag in a state where the opening portion of the banknote storage bag 274 is opened or in a state where the opening portion of the banknote storage bag 274 is sealed; the heating members 278 as a sealing unit for sealing the opening portion of the banknote storage bag 274 held by each holding member 276; and the shutter mechanism 262 as a regulation unit for selectively regulating access to the banknote storage bag 274 held by each holding member 276. The control unit 250 controls the shutter mechanism 262 as the regulation unit so as to allow access to the banknote storage bag 274 held by each holding member 276 in a state where the opening portion of the banknote storage bag 274 is opened, when a predetermined condition has been satisfied. Thus, when the predetermined condition has been satisfied, a sheet such as a valuable medium can be additionally stored into the banknote storage bag 274 held by each holding member 276 or a banknote can be taken out from the banknote storage bag 274 in a state where the opening portion of the banknote storage bag 274 is opened, by allowing access to the banknote storage bag 274 held by each holding member 276 in a state where the opening portion of the banknote storage bag 274 is opened.

The sheet handling apparatus according to the present invention is not limited to an apparatus such as the banknote handling machine 10 shown in FIG. 1 to FIG. 7 or the banknote depositing machine 210 shown in FIG. 19 to FIG. 21 for performing handling of banknotes. As the sheet handling apparatus according to the present invention, an apparatus for performing handling of a sheet (for example, voucher, check, coupon, and the like) other than a banknote may be used.

The invention claimed is:

1. A sheet storage apparatus comprising:

a housing;

a holding unit configured to hold a storage bag in a state where an opening portion of the storage bag is opened or in a state where the opening portion of the storage bag is sealed;

a drawer unit in which at least the holding unit is disposed, the drawer unit configured to be drawn outward from the housing;

a sealing unit configured to seal the opening portion of the storage bag held by the holding unit;

a regulation unit configured to selectively regulate access to the storage bag held by the holding unit; and a control unit configured to control the regulation unit so as to allow access to the storage bag held by the holding unit in a state where the opening portion of the storage bag is opened when a predetermined condition is satisfied, wherein the regulation unit includes a locking unit configured to regulate drawing of the drawer unit to outside of the housing, and the control unit controls the locking unit so as to allow the drawer unit to be drawn to outside of the housing when the predetermined condition is satisfied.

2. The sheet storage apparatus according to claim 1, further comprising:

a door provided with the housing, the door configured to be opened when the drawer unit is drawn outward from the housing, wherein the locking unit includes a door locking unit configured to lock the door in a closed state, and the control unit controls the door locking unit so as to unlock the door having been in the closed state when the predetermined condition is satisfied.

3. The sheet storage apparatus according to claim 1, further comprising:

a taking-in unit configured to take in a sheet into the housing;

a transport unit configured to transport the sheet taken in into the housing by the taking-in unit; and a recognition unit configured to recognize the sheet transported by the transport unit, wherein the control unit controls the regulation unit so as to allow the sheet to be stored into the storage bag held by the holding unit without transporting the sheet through the taking-in unit, the transport unit, and the recognition unit when the predetermined condition is satisfied.

4. The sheet storage apparatus according to claim 3, wherein the control unit determines that the predetermined condition is satisfied when an instruction for inserting the sheet in the storage bag held by the holding unit without transporting the sheet through the taking-in unit, the transport unit, and the recognition unit, is inputted.

5. The sheet storage apparatus according to claim 4, further comprising an instruction unit configured to output the instruction to insert the sheet in the storage bag held by the holding unit without transporting the sheet through the taking-in unit, the transport unit, and the recognition unit, wherein the instruction to insert the sheet in the storage bag held by the holding unit without transporting the sheet through the taking-in unit, the transport unit, and the recognition unit, is inputted into the control unit when the instruction unit is operated.

6. The sheet storage apparatus according to claim 3, further comprising an input unit configured to allow input of information on the sheet to be stored in the storage bag held by the holding unit without transporting the sheet through the taking-in unit, the transport unit, and the recognition unit.

7. The sheet storage apparatus according to claim 3, wherein information on the sheet which is stored into the storage bag held by the holding unit without transporting the sheet through the taking-in unit, the transport unit, and the recognition unit, and information on a sheet which is stored into a storage bag held by the holding unit through the taking-in unit, the transport unit, and the recognition unit, are managed by the control unit so as to be distinguished from each other.

8. The sheet storage apparatus according to claim 1, further comprising an authentication unit configured to perform authentication of authority of an operator, wherein the control unit determines that the predetermined condition is satisfied when the authority of the operator authenticated by the authentication unit is a predetermined authority.

9. A sheet storage apparatus comprising:

a housing;

a holding unit configured to hold a storage bag in a state where an opening portion of the storage bag is opened or in a state where the opening portion of the storage bag is sealed;

a sealing unit configured to seal the opening portion of the storage bag held by the holding unit;

a regulation unit configured to selectively regulate access to the storage bag held by the holding unit; and a control unit configured to control the regulation unit so as to allow access to the storage bag held by the holding unit in a state where the opening portion of the storage bag is opened when a predetermined condition is satisfied, wherein:

the regulation unit includes an opening and closing unit for opening or closing a path between outside of the housing and the opening portion of the storage bag held by the holding unit; and the control unit controls the opening and closing unit so as to open the path between outside of the housing and the opening portion of the storage bag held by the holding unit when the predetermined condition is satisfied.

10. The sheet storage apparatus according to claim 9, further comprising:

a taking-in unit configured to take in a sheet into the housing;

a transport unit configured to transport the sheet taken in into the housing by the taking-in unit; and a recognition unit configured to recognize the sheet transported by the transport unit, wherein the control unit controls the regulation unit so as to allow the sheet to be stored into the storage bag held by the holding unit without transporting the sheet through the taking-in unit, the transport unit, and the recognition unit when the predetermined condition is satisfied.

11. The sheet storage apparatus according to claim 10, wherein the control unit determines that the predetermined condition is satisfied when an instruction for inserting the sheet in the storage bag held by the holding unit without transporting the sheet through the taking-in unit, the transport unit, and the recognition unit, is inputted.

12. The sheet storage apparatus according to claim 11, further comprising an instruction unit configured to output the instruction to insert the sheet in the storage bag held by the holding unit without transporting the sheet through the taking-in unit, the transport unit, and the recognition unit, wherein the instruction to insert the sheet in the storage bag held by the holding unit without transporting the sheet through the taking-in unit, the transport unit, and the recognition unit, is inputted into the control unit when the instruction unit is operated.

13. The sheet storage apparatus according to claim 10, further comprising an input unit configured to allow input of information on the sheet to be stored in the storage bag held by the holding unit without transporting the sheet through the taking-in unit, the transport unit, and the recognition unit.

14. The sheet storage apparatus according to claim 10, wherein information on the sheet which is stored into the storage bag held by the holding unit without transporting the sheet through the taking-in unit, the transport unit, and the recognition unit, and information on a sheet which is stored into a storage bag held by the holding unit through the taking-in unit, the transport unit, and the recognition unit, are managed by the control unit so as to be distinguished from each other.

15. The sheet storage apparatus according to claim 9, further comprising an authentication unit configured to perform authentication of authority of an operator, wherein the control unit determines that the predetermined condition is satisfied when the authority of the operator authenticated by the authentication unit is a predetermined authority.

16. A sheet storage method performed by a sheet storage apparatus comprising: a taking-in unit configured to take in a sheet into a housing; a transport unit configured to transport the sheet taken in into the housing by the taking-in unit; a recognition unit configured to recognize the sheet transported by the transport unit; a holding unit configured to hold a storage bag in a state where an opening portion of the storage bag is opened or in a state where the opening portion of the storage bag is sealed; and a sealing unit configured to seal the opening portion of the storage bag held by the holding unit, the sheet storage method comprising:

storing a sheet in the storage bag held by the holding unit in a state where the opening portion of the storage bag is opened while regulating access to the storage bag held by the holding unit;

sealing the opening portion of the storage bag held by the holding unit, by the sealing unit, when the storage bag is taken out from the sheet storage apparatus; and allowing access to the storage bag held by the holding unit in a state where the opening portion of the storage bag is opened when a predetermined condition is satisfied, wherein:

in storing the sheet in the storage bag held by the holding unit in a state where the opening portion of the storage bag is opened, the sheet is stored into the storage bag held by the holding unit through the taking-in unit, the transport unit, and the recognition unit, and when the predetermined condition is satisfied, the sheet is allowed to be stored into the storage bag held by the holding unit without transporting the sheet through the taking-in unit, the transport unit, and the recognition unit.

* * * * *